US010630020B2

(12) United States Patent
Hamada

(10) Patent No.: US 10,630,020 B2
(45) Date of Patent: Apr. 21, 2020

(54) CABLE CONNECTION STRUCTURE AND MANUFACTURING METHOD OF THE CABLE CONNECTION STRUCTURE

(71) Applicant: Yazaki Corporation, Tokyo (JP)

(72) Inventor: Ryo Hamada, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 16/296,884

(22) Filed: Mar. 8, 2019

(65) Prior Publication Data

US 2019/0280423 A1 Sep. 12, 2019

(30) Foreign Application Priority Data

Mar. 12, 2018 (JP) ..... 2018-043944

(51) Int. Cl.

| | |
|---|---|
| ***H01R 13/52*** | (2006.01) |
| ***H01R 43/00*** | (2006.01) |
| ***H01R 43/24*** | (2006.01) |
| ***H01R 12/63*** | (2011.01) |
| ***H01R 4/72*** | (2006.01) |
| *H01R 43/02* | (2006.01) |

(52) U.S. Cl.

CPC ..... *H01R 13/5205* (2013.01); *H01R 4/72* (2013.01); *H01R 12/63* (2013.01); *H01R 43/005* (2013.01); *H01R 43/24* (2013.01); *H01R 43/0207* (2013.01)

(58) Field of Classification Search

CPC ..... H01R 13/5205; H01R 4/72; H01R 12/63; H01R 43/005; H01R 43/24; H01R 43/0207

USPC ..... 439/271–276, 278–282

See application file for complete search history.

(56) References Cited

U.S. PATENT DOCUMENTS

| | | | | |
|---|---|---|---|---|
| 3,852,517 | A | 12/1974 | Fava | |
| 5,021,611 | A | 6/1991 | Amano | |
| 5,770,818 | A * | 6/1998 | Tanaka | B60R 16/027 174/84 R |
| 5,780,774 | A * | 7/1998 | Ichikawa | H01R 12/61 174/117 FF |
| 6,247,977 | B1 | 6/2001 | Tanaka et al. | |
| 6,376,773 | B1 | 4/2002 | Maegawa | |
| 8,784,119 | B2 * | 7/2014 | Tseng | H01R 12/63 439/495 |

FOREIGN PATENT DOCUMENTS

| | | | |
|---|---|---|---|
| EP | 0810122 | A2 | 12/1997 |
| JP | 2000-348791 | A | 12/2000 |

* cited by examiner

*Primary Examiner* — Khiem M Nguyen
(74) *Attorney, Agent, or Firm* — Sughrue Mion, PLLC

(57) ABSTRACT

A cable connection structure includes a round cable, a flat cable, a holder holding an end portion of the round cable and an end portion of the flat cable and pulling out the round cable and the flat cable to overlap each other in a same direction, a connecting portion in which a core wire exposed from the end portion of the round cable and a conductor exposed from the end portion of the flat cable held by the holder are connected to each other, and a mold resin portion collectively covering the outer circumference of the holder and the outer circumference of the round cable and the flat cable pulled out from the holder.

10 Claims, 20 Drawing Sheets

CABLE CONNECTION STRUCTURE AND MANUFACTURING METHOD OF THE CABLE CONNECTION STRUCTURE

CROSS REFERENCE TO RELATED APPLICATION

The present application is based on, and claims priority from Japanese Patent Application No. 2018-043944, filed Mar. 12, 2018, the disclosure of which is hereby incorporated by reference herein in its entirety.

TECHNICAL FIELD

The present application relates to a cable connection structure for connecting a round cable and a flat cable and a manufacturing method of the cable connection structure.

BACKGROUND ART

A conventional cable connection structure of this kind is illustrated in FIG. 19. In FIG. 19, the conventional cable connection structure includes a holder 50, a plurality of round cables W1 held by the holder 50, a flat cable W2 held by the holder 50, and a mold resin portion 51 covering the outer circumference of the holder 50.

The plurality of round cables W1 and the flat cable W2 held by the holder 50 overlap each other at the end portions thereof, and are pulled out in mutually opposite directions. Core wires (not illustrated) at end portions of the round cables W1 and conductors (not illustrated) at an end portion of the flat cable W2 are connected to each other by connecting portions 53 formed by ultrasonic welding or the like.

The mold resin portion 51 collectively covers the holder 50 and the round cables W1 and the flat cable W2 pulled out from the holder 50. Accordingly, the portion including the connecting portions 53 is waterproofed by the mold resin portion 51.

The core wires (not illustrated) of the round cables W1 and the conductors (not illustrated) of the flat cable W2 are connected by, for example, ultrasonic welding using an ultrasonic welding device 30, as illustrated in FIG. 20. The ultrasonic welding device 30 includes an anvil 34 that places the holder 50 in a positioned state, and a horn 33 that applies, while applying pressure, ultrasonic vibration (in the direction of the arrow in FIG. 10) to the position in which the core wires (not illustrated) of the round cables W1 and the conductors (not illustrated) of the flat cable W2 overlap each other. The horn 33 is provided at the distal end of an arm portion 32 whose base end portion is supported by a device main body 31.

Incidentally, when the holder 50 holding the round cables W1 and the flat cable W2 is set in the ultrasonic welding device 30, the round cables W1 may have to be set away from the ultrasonic welding device 30, and the flat cable W2 may have to be set in the space between the horn 33 and the device main body 31 in some cases. For example, in a case where the round cables W1 compose a long wire harness (not illustrated), the wire harness (not illustrated) may not be set in the space between the horn 33 and the device main body 31.

SUMMARY

Although the flat cable W2 is excellent in flexibility in the direction of bending the flat surface, it can hardly be bent in the direction orthogonal to the flat surface (lateral direction).

Therefore, there is a problem that it is difficult to perform ultrasonic welding in a case where the flat cable W2 is sufficiently longer than the distance between the horn 33 and the device main body 31. There is a similar problem with a connecting device other than the ultrasonic welding device 30.

The present application has been conceived to solve the problem described above, and an object of the present application is to provide a cable connection structure, as well as a manufacturing method of the cable connection structure, capable of being manufactured using a connecting device such as an ultrasonic welding device regardless of a length of a flat cable.

A cable connection structure according to a first aspect of the present application includes: a round cable having a round cross section and including a core wire and a round insulating sheath covering the outer circumference of the core wire; a flat cable having a cross section in a flat rectangular shape and including a tabular conductor and a flat insulating sheath covering the conductor; a holder holding the end portion of the round cable and the end portion of the flat cable and pulling out the round cable and the flat cable in the same direction in an overlapped state; a connecting portion in which the core wire exposed from an end portion of the round cable and the conductor exposed from an end portion of the flat cable held by the holder are connected to each other; and a waterproof exterior portion collectively covering the outer circumference of the holder and the outer circumference of the round cable and the flat cable pulled out from the holder.

A manufacturing method of a cable connection structure according to a second aspect of the present application includes: a cable setting step of holding, in a state in which a round cable and a flat cable are pulled out in a same direction in an overlapped state, the end portion of the round cable and the end portion of the flat cable in a holder; a connecting step of connecting a core wire exposed from the end portion of the round cable held by the holder and a conductor exposed from the end portion of the flat cable held by the holder; and an exterior forming step of forming a waterproof exterior portion covering, with an insulating resin, the holder, the round cable pulled out from the holder, and the flat cable pulled out from the holder.

According to the aspects of the present application, in the connecting step of connecting the core wire exposed from the end portion of the round cable and the conductor exposed from the end portion of the flat cable, the round cable and the flat cable are pulled out from the holder in the same direction, whereby it can be manufactured using a connecting device such as an ultrasonic welding device regardless of a length of the flat cable.

DETAILED DESCRIPTION

Figure 1A:
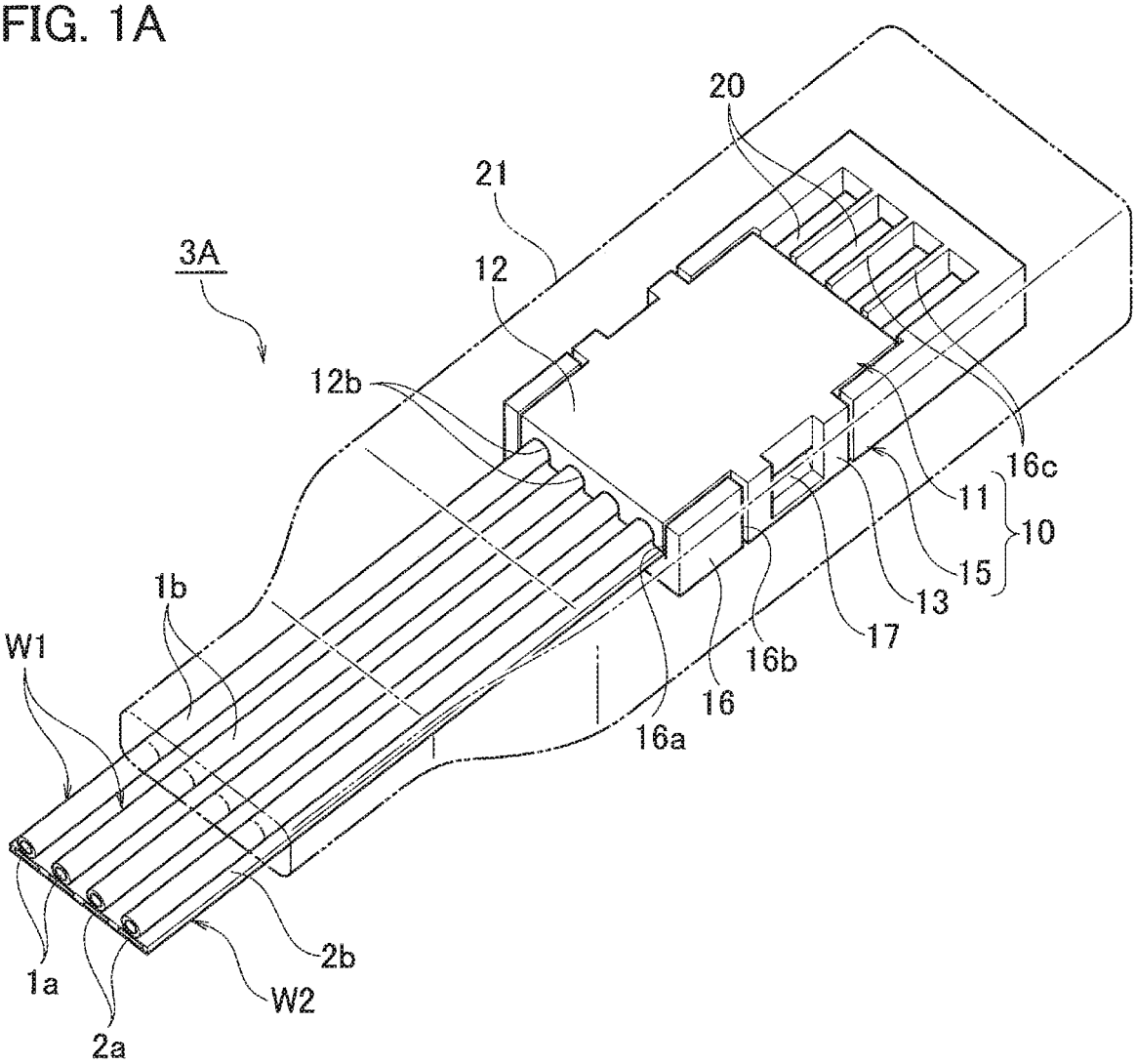
FIG. 1A is a perspective view of a cable connection structure according to a first embodiment (a mold resin portion is illustrated by a virtual line)

Hereinafter, embodiments will be described with reference to the drawings.

First Embodiment

FIGS. 1A to 5 illustrate a first embodiment. A cable connection structure 3A according to the first embodiment includes a plurality of round cables W1, a flat cable W2, a holder 10 for holding end portions of the plurality of round cables W1 and the end portion of the flat cable W2, connecting portions 20 in each of which a core wire 1*a* of each of the round cables W1 and a corresponding conductor 2*a* of the flat cable W2 are connected, and a mold resin portion 21 that is a waterproof exterior portion covering an outer circumference of the holder 10.

Each of the round cables W1 has a round cross section, and includes the core wire 1*a* and an insulating sheath 1*b* covering the outer circumference of the core wire 1*a*. The core wire 1*a* is exposed from the insulating sheath 1*b* at an end portion of each of the round cables W1.

The flat cable W2 has a cross section in a flat rectangular shape, and includes a plurality of tabular conductors 2*a* arranged in parallel at intervals, and an insulating sheath 2*b* collectively covering the plurality of tabular conductors 2*a*. Each of the conductors 2*a* is exposed from the insulating sheath 2*b* at an end portion of the flat cable W2.

The holder 10 includes a round cable holder 11 for holding the end portions of the round cables W1, and a flat cable holder 15 for holding the end portion of the flat cable W2.

Figure 2:
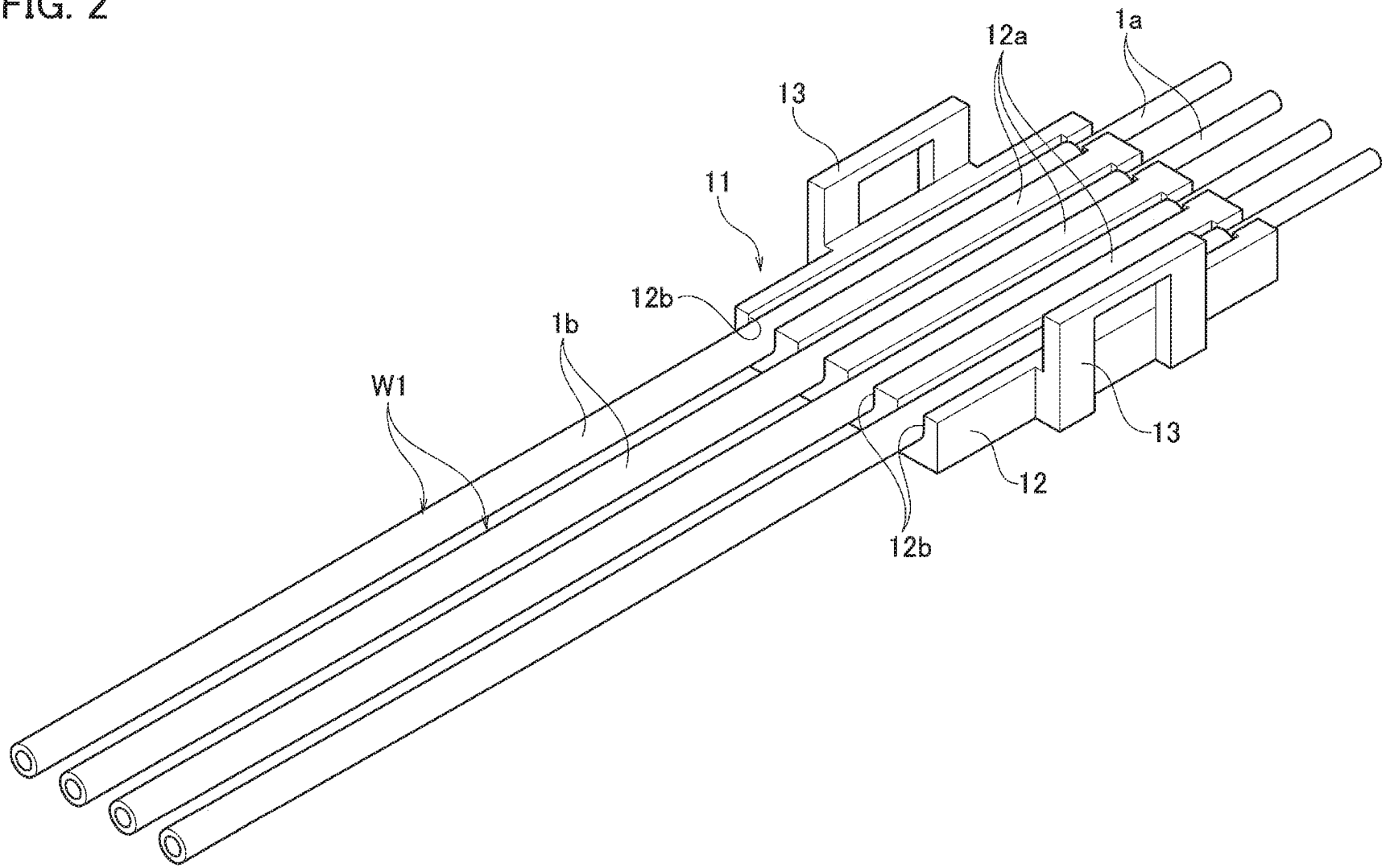
FIG. 2 is a perspective view of round cables set in a round cable holder in the cable connection structure according to the first embodiment.

The round cable holder 11 is formed of an insulating material. As illustrated in FIG. 2, the round cable holder 11 includes a round cable holder main body 12 in which a plurality of round cable arrangement grooves 12*b* partitioned by dividing walls 12*a* is formed in parallel with each other, and a pair of lock frames 13 protruding from the side end portions of the round cable holder main body 12. Each of upper surfaces of the dividing walls 12*a* of the round cable holder main body 12 is an abutting surface. Each of the round cables W1 is arranged in the round cable arrangement groove 12*b* in such a manner that the core wire 1*a* exposed at the end portion protrudes from the round cable holder 11.

Figure 3A:
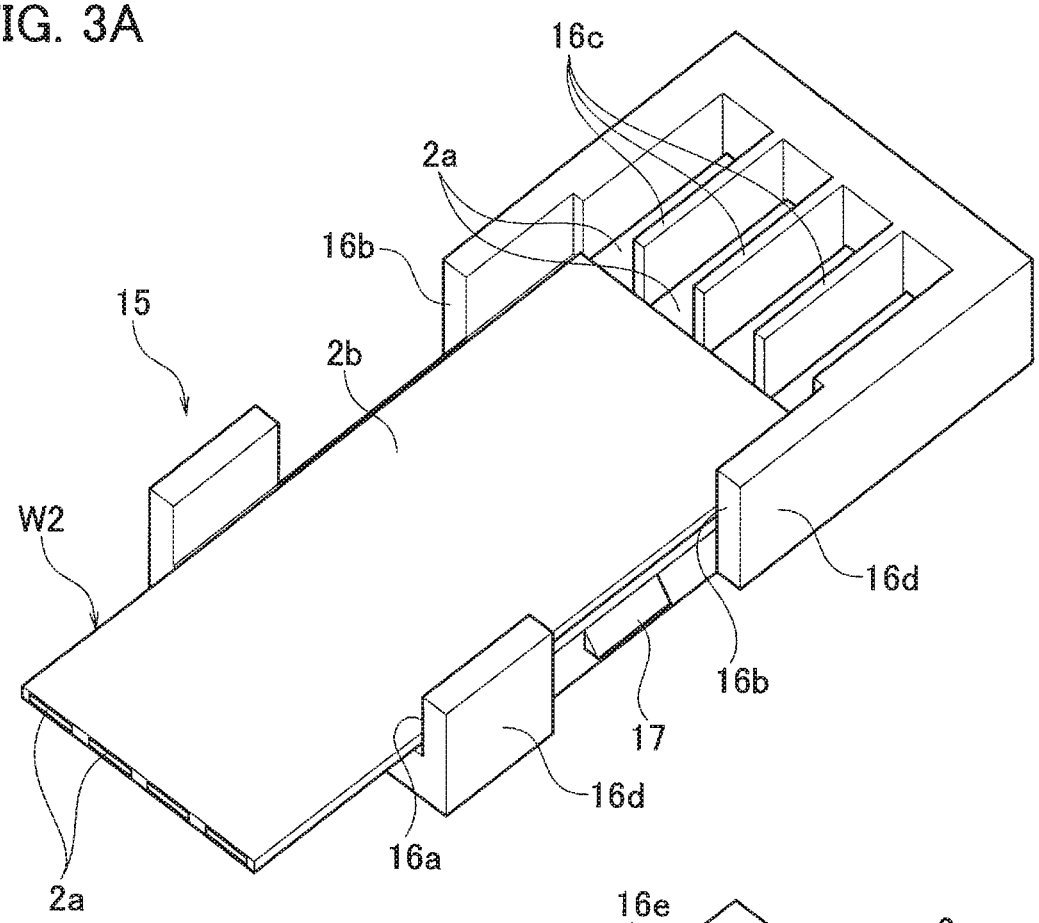
FIG. 3A is a perspective view of a flat cable set in a flat cable holder in the cable connection structure according to the first embodiment.
Figure 3B:
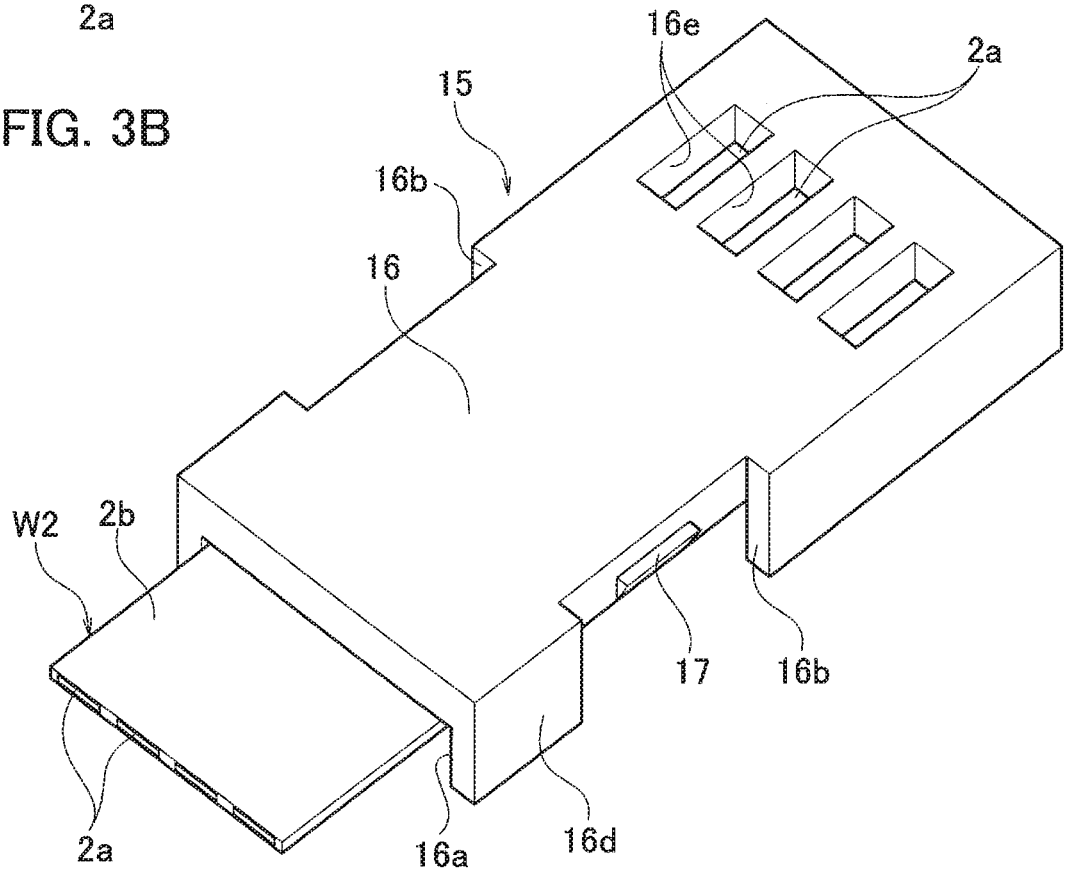
FIG. 3B is a perspective view as seen from the opposite side of FIG. 3A.

The flat cable holder 15 is formed of an insulating material. As illustrated in FIGS. 3A and 3B, the flat cable holder 15 includes a flat cable holder main body 16 in which a flat cable arrangement chamber 16*a* is formed, and a pair of lock claws 17 provided on surfaces exposed by cutout portions 16*b* of the flat cable holder main body 16. The distal end side of the flat cable arrangement chamber 16*a* of the flat cable holder main body 16 in the crosswise direction is partitioned by a plurality of partition walls 16*c*. An upper surface of a side wall 16*d* of the flat cable holder main body 16 is a flush surface. The portion of the flat cable arrangement chamber 16*a* partitioned by the partition wall 16*c* is opened to the outside in the state of the holder 10 in which the round cable holder 11 and the flat cable holder 15 are joined together. At the time of ultrasonic welding, a horn 33 of an ultrasonic welding device 30 is inserted from the portion opened to the outside of the holder 10. On the back side of the flat cable holder main body 16, a plurality of through holes 16*e* opened to the position of the flat cable arrangement chamber 16*a* partitioned by the partition wall 16*c* is formed. At the time of ultrasonic welding, an anvil 34 of the ultrasonic welding device 30 is inserted from the through hole 16*e*. The flat cable W2 is arranged in the flat cable arrangement chamber 16*a* in such a manner that respective conductors 2*a* exposed at the end portion of the flat cable W2 are positioned at respective portions partitioned by the partition walls 16*c*.

Figure 4:
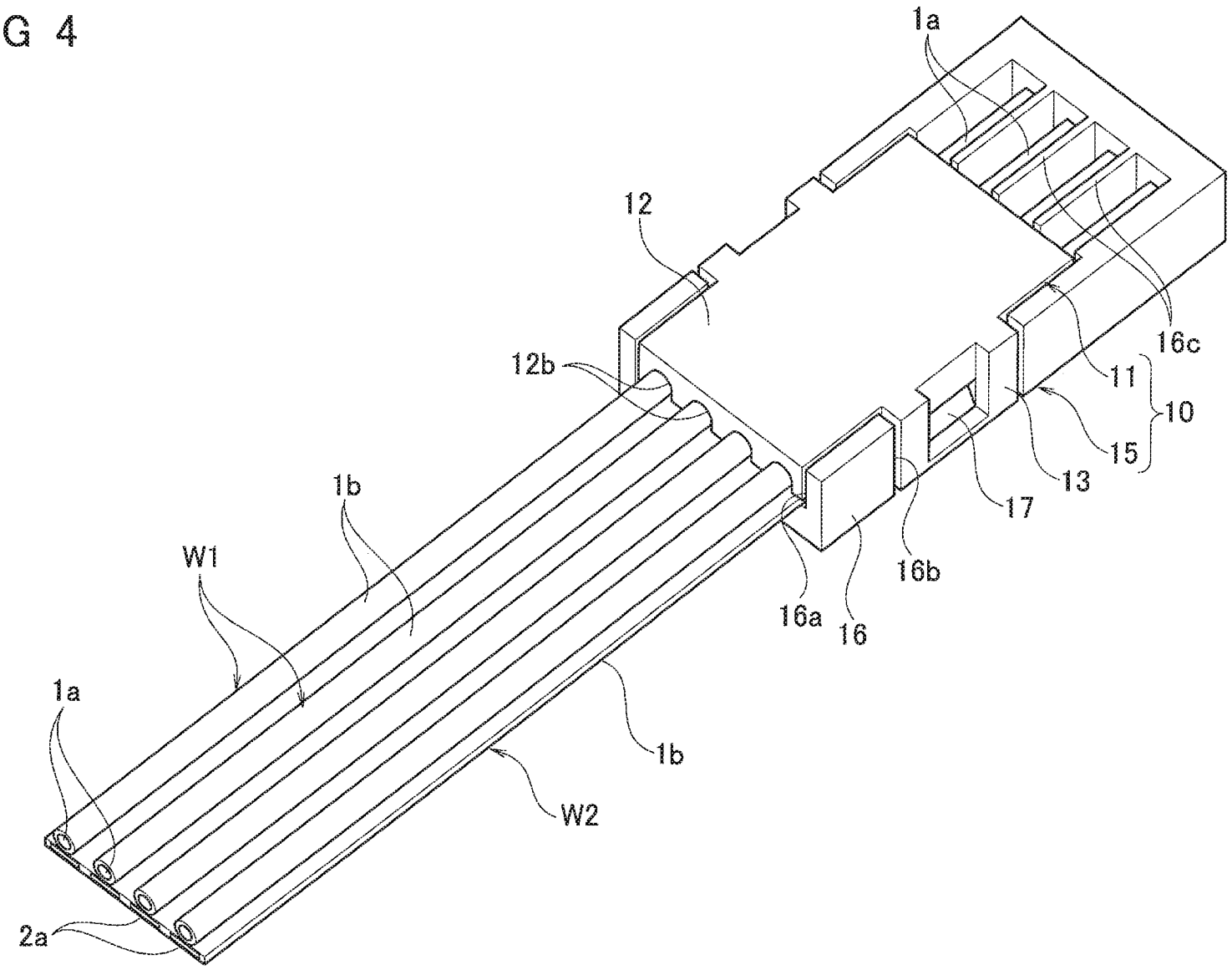
FIG. 4 is a perspective view of the round cable holder and the flat cable holder in a combined state in the cable connection structure according to the first embodiment.

As illustrated in FIG. 4, the round cable holder 11 and the flat cable holder 15 are joined together by abutting the upper surfaces of the dividing walls 12*a* of the round cable holder main body 12 and a surface of the flat cable W2 arranged in the flat cable arrangement chamber 16*a*. Accordingly, the round cable holder 11 and the flat cable holder 15 are joined together in such a manner that the round cables W1 from the round cable holder 11 and the flat cable W2 from the flat cable holder 15 overlap with each other and are pulled out in the same direction. Further, the end portions of the round cables W1 and the end portion of the flat cable W2 are arranged to overlap each other, and are exposed to the outside.

The mold resin portion 21 is formed of an insulating resin. The mold resin portion 21 collectively covers, with no gap left, the outer exposed surface of the round cable holder 11, the outer exposed surface of the flat cable holder 15, the outer circumference of each of the round cables W1 pulled out from the round cable holder 11, and the outer circumference of the flat cable W2 pulled out from the flat cable holder 15.

In the cable connection structure 3A according to the first embodiment, the mold resin is firmly attached onto, with no gap left, the outer circumference surface of each of the round cables W1 and the outer circumference surface of the flat cable W2 at the positions of the round cables W1 pulled out from the mold resin portion 21 to the outside and the position of the flat cable W2 also pulled out from the mold resin portion 21 to the outside, thereby securing waterproof property of the connecting portion 20.

The holder 10 includes the round cable holder 11 and the flat cable holder 15, and the round cables W1 are held by the round cable holder 11 while the flat cable W2 is held by the flat cable holder 15, thereby achieving good workability of holding cables with the holder 10.

Next, a manufacturing method of the cable connection structure 3A according to the first embodiment will be described. The manufacturing method of the cable connection structure 3A is performed in the order of a cable setting step, a connecting step, and an insert resin molding step that is an exterior forming step. The cable setting step includes a cable holding step and a holder combining step. Hereinafter, the manufacturing method of the cable connection structure 3A will be described in order.

In the cable holding step, the round cables W1 are held in the round cable holder 11, and the flat cable W2 is held in the flat cable holder 15. Specifically, as illustrated in FIG. 2, a plurality of round cables W1 is arranged in the round cable arrangement grooves 12*b* of the round cable holder 11 in such a manner that the core wire 1*a* exposed from the end portion of each of the round cables W1 protrudes outside the round cable holder 11 (round cable holding step). Further, as illustrated in FIGS. 3A and 3B, the flat cable W2 is arranged in the flat cable arrangement chamber 16*a* in such a manner that the conductors 2*a* exposed from the end portion of the flat cable W2 are positioned at the flat cable arrangement chamber 16*a* partitioned by the partition walls 16*c* (flat cable holding step). The round cable holding step with respect to the round cable holder 11 and the flat cable holding step with respect to the flat cable holder 15 may be performed in no particular order, and may be performed simultaneously.

In the holder combining step, the round cable holder 11 and the flat cable holder 15 are joined together. Specifically, as illustrated in FIG. 4, the upper surfaces of the dividing walls 12*a* of the round cable holder main body 12 and the surface of the flat cable W2 arranged in the flat cable arrangement chamber 16*a* are abutted each other, and the lock claws 17 are locked to the lock frames 13. In the state where the round cable holder 11 and the flat cable holder 15 are joined together, the core wires 1*a* exposed from the end portions of the plurality of round cables W1 and the conductors 2*a* exposed from the end portion of the flat cable W2 are arranged to overlap each other, and are exposed to the outside. The round cables W1 and the flat cable W2 from the combined round cable holder 11 and the flat cable holder 15 are pulled out to overlap each other in the same direction.

Figure 5:
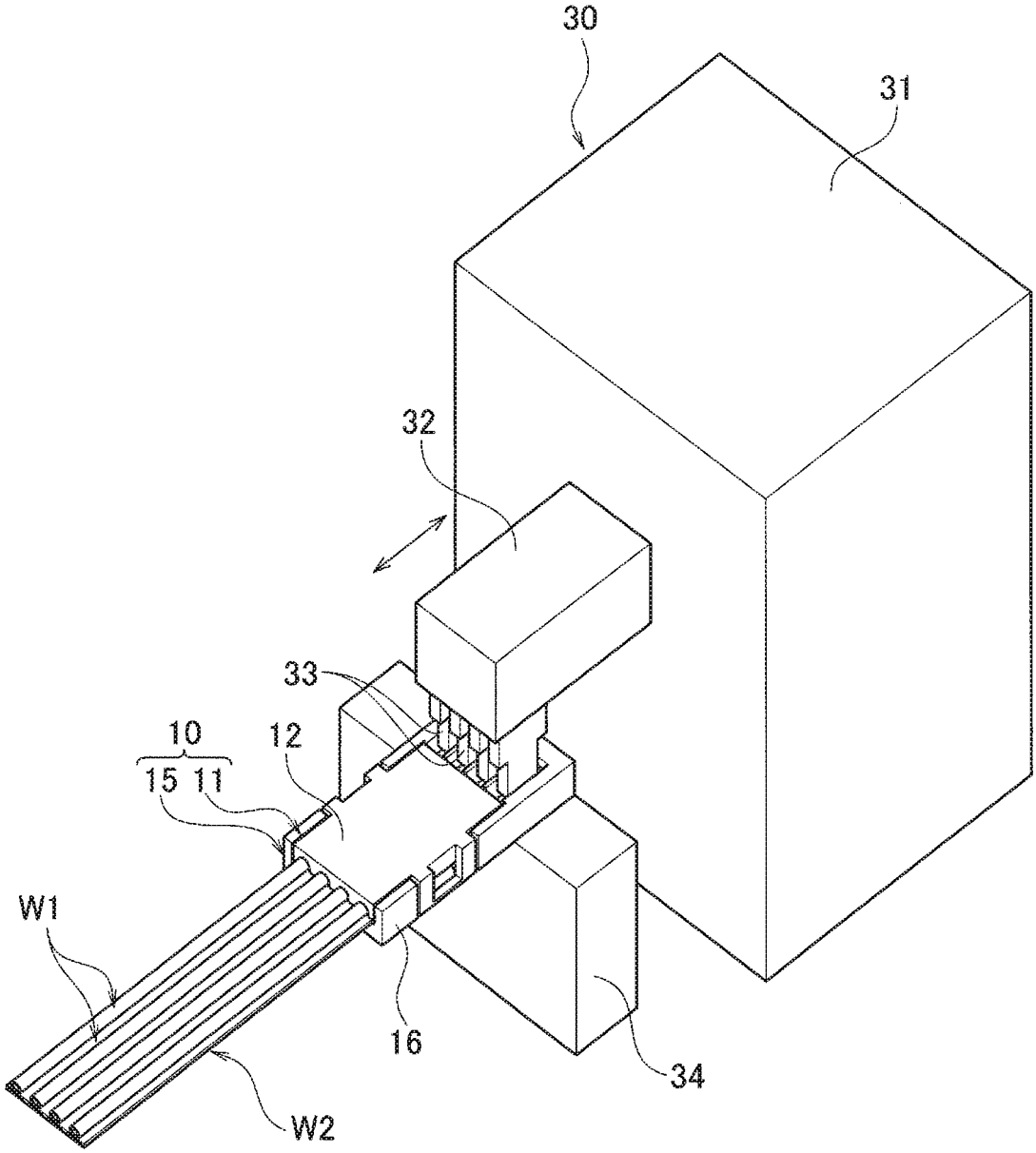
FIG. 5 is a perspective view illustrating a state of ultrasonic welding in the cable connection structure according to the first embodiment.

In the connecting step, the round cables W1 and the flat cable W2 are electrically connected by ultrasonic welding using the ultrasonic welding device 30. As illustrated in FIG. 5, the ultrasonic welding device 30 includes the anvil 34, and the horn 33 arranged at the position facing the anvil 34. The horn 33 is provided at the distal end of an arm portion 32 whose base end portion is supported by a device main body 31.

Specifically, in the connecting step, the round cables W1 and the flat cable W2 pulled out from the combined round cable holder 11 and the flat cable holder 15 are not arranged in the space between the horn 33 and the device main body 31, but are arranged in the open space on the opposite side, in such a manner that the combined round cable holder 11 and the flat cable holder 15 are positioned on the anvil 34. Then, by the branched horn 33, ultrasonic vibration is applied (in the direction of the arrow in FIG. 5) to, while pressure is applied, the position in which the core wires 1*a* of the round cables W1 and the conductors 2*a* of the flat cable W2 overlap each other. As a result, the core wires 1*a* of the round cables W1 and the conductors 2*a* of the flat cable W2 are connected by the ultrasonic welding, respectively.

Figure 1B:
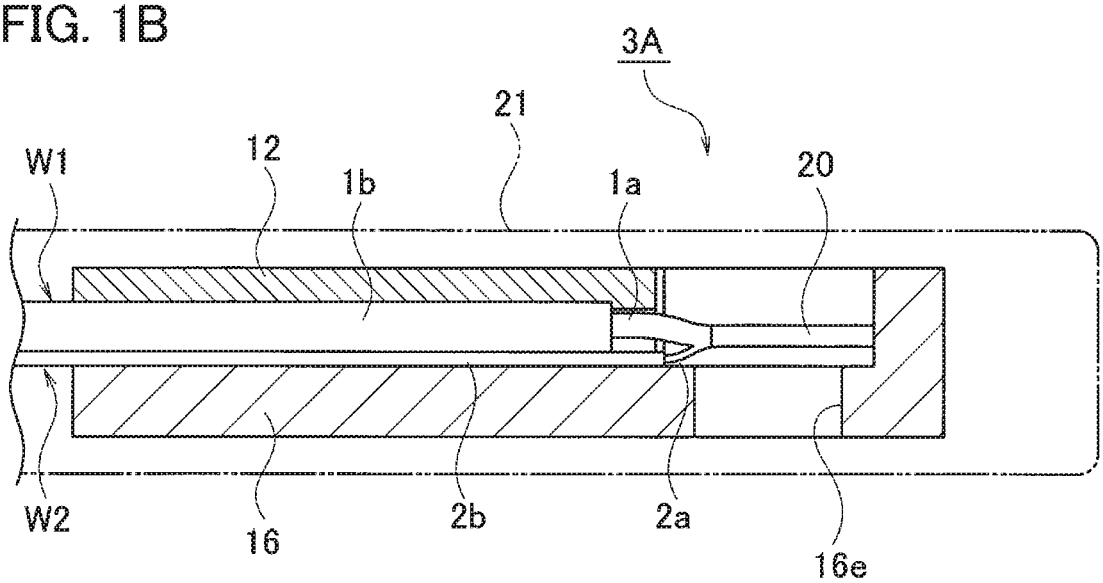
FIG. 1B is a cross-sectional view of a main part of the cable connection structure according to the first embodiment.

In the insert resin molding step, insert resin molding is performed with the round cable holder 11, the flat cable holder 15, the round cables W1 pulled out from the round cable holder 11, and the flat cable W2 pulled out from the flat cable holder 15 serving as inserts, and the mold resin portion 21 is molded. In this manner, the cable connection structure 3A as illustrated in FIGS. 1A and 1B is produced.

As described above, the cable connection structure 3A according to the first embodiment includes the round cables W1 each having a round cross section and including the core wire 1*a* and the round insulating sheath 1*b* covering the outer circumference of the core wire 1*a*, the flat cable W2 having a cross section in a flat rectangular shape and including the tabular conductors 2*a* and the flat insulating sheath 2*b* covering the conductors 2*a*, the holder 10 holding the end portions of the round cables W1 and the end portion of the flat cable W2 and pulling out the round cables W1 and the flat cable W2 in the same direction in an overlapped state, the connecting portions 20 in which the core wires 1*a* exposed from the end portions of the round cables W1 and the conductors 2*a* exposed from the end portion of the flat cable W2 held by the holder 10 are connected, and the mold resin portion 21 as a waterproof exterior portion that collectively covers the outer circumference of the holder 10 and the outer circumference of the round cables W1 and the flat cable W2 pulled out from the holder 10. In the step of connecting the core wires 1*a* of the round cables W1 and the conductors 2*a* of the flat cable W2, the round cables W1 and the flat cable W2 are pulled out from the holder 10 in the same direction, whereby it can be manufactured using a connecting device such as the ultrasonic welding device 30 regardless of a length of the flat cable W2.

Second Embodiment

Figure 6A:
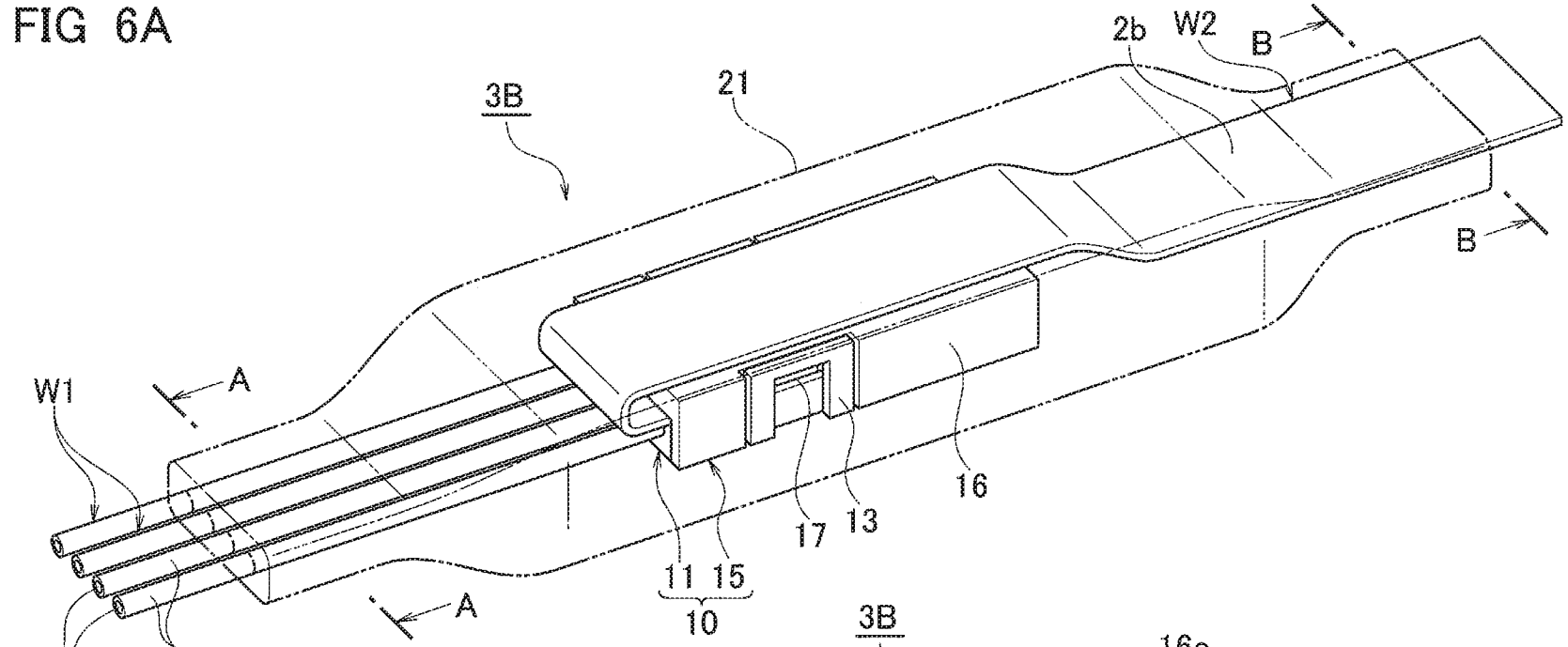
FIG. 6A is a perspective view of a cable connection structure according to a second embodiment (a mold resin portion is illustrated by a virtual line)

FIGS. 6A to 8B illustrate a second embodiment. A cable connection structure 3B according to the second embodiment is different from the cable connection structure 3A according to the first embodiment in the following points. That is, as illustrated in FIGS. 6A and 6B, in the cable connection structure 3B according to the second embodiment, a flat cable W2 is bent to be guided in the direction different from the pulled-out direction from a flat cable holder 15, specifically, in the diametrically opposite pulled-out direction. Round cables W1 and the flat cable W2 are pulled out from a mold resin portion 21 in different directions, specifically, in the directions diametrically opposed to each other.

Other configurations in the second embodiment are the same as those in the first embodiment, and the same constituent elements are denoted by the same reference signs to omit redundant descriptions.

Figure 8A:
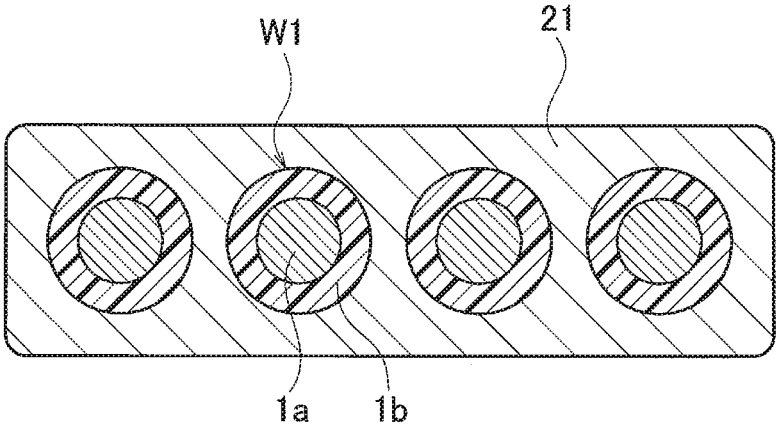
FIG. 8A is a cross-sectional view taken along line A-A in FIG. 6A.
Figure 8B:
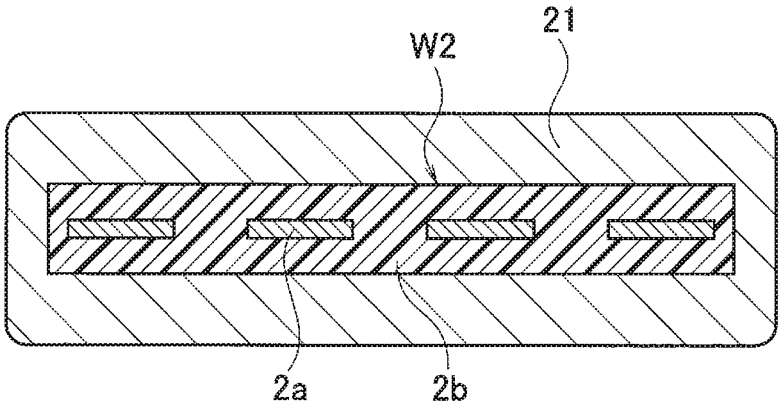
FIG. 8B is a cross-sectional view taken along line B-B in FIG. 6A.

As illustrated in FIGS. 8A and 8B, in the cable connection structure 3B according to the second embodiment, mold resin is firmly attached onto, with no gap left, the outer circumference surface of each of the round cables W1 and the outer circumference surface of the flat cable W2 at the position of the round cables W1 pulled out from the mold resin portion 21 to the outside and the position of the flat cable W2 also pulled out from the mold resin portion 21 to the outside, thereby securing waterproof property of the connecting portions 20.

Figure 6B:
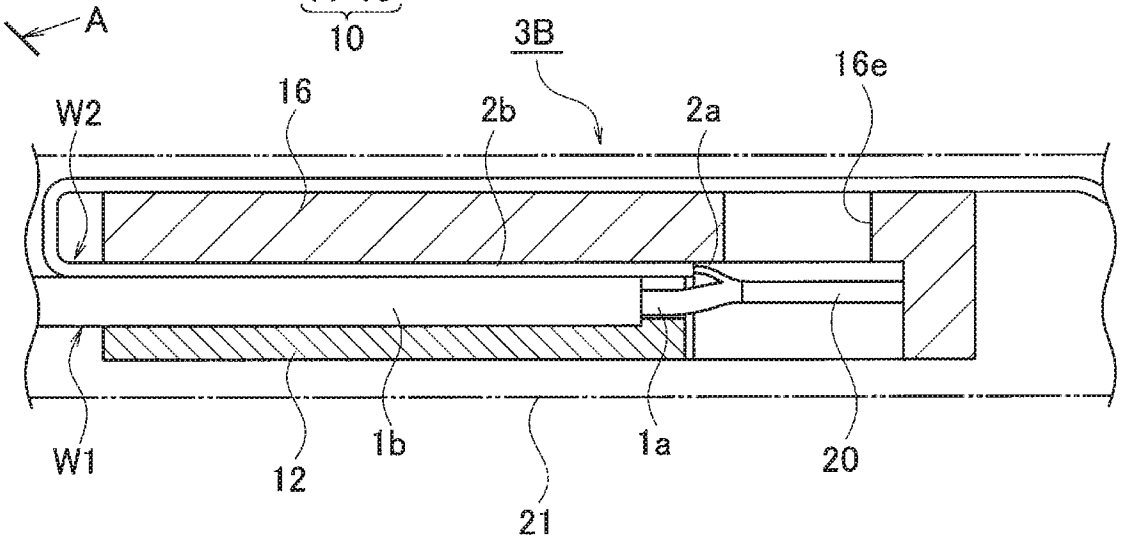
FIG. 6B is a cross-sectional view of a main part of the cable connection structure according to the second embodiment.
Figure 7:
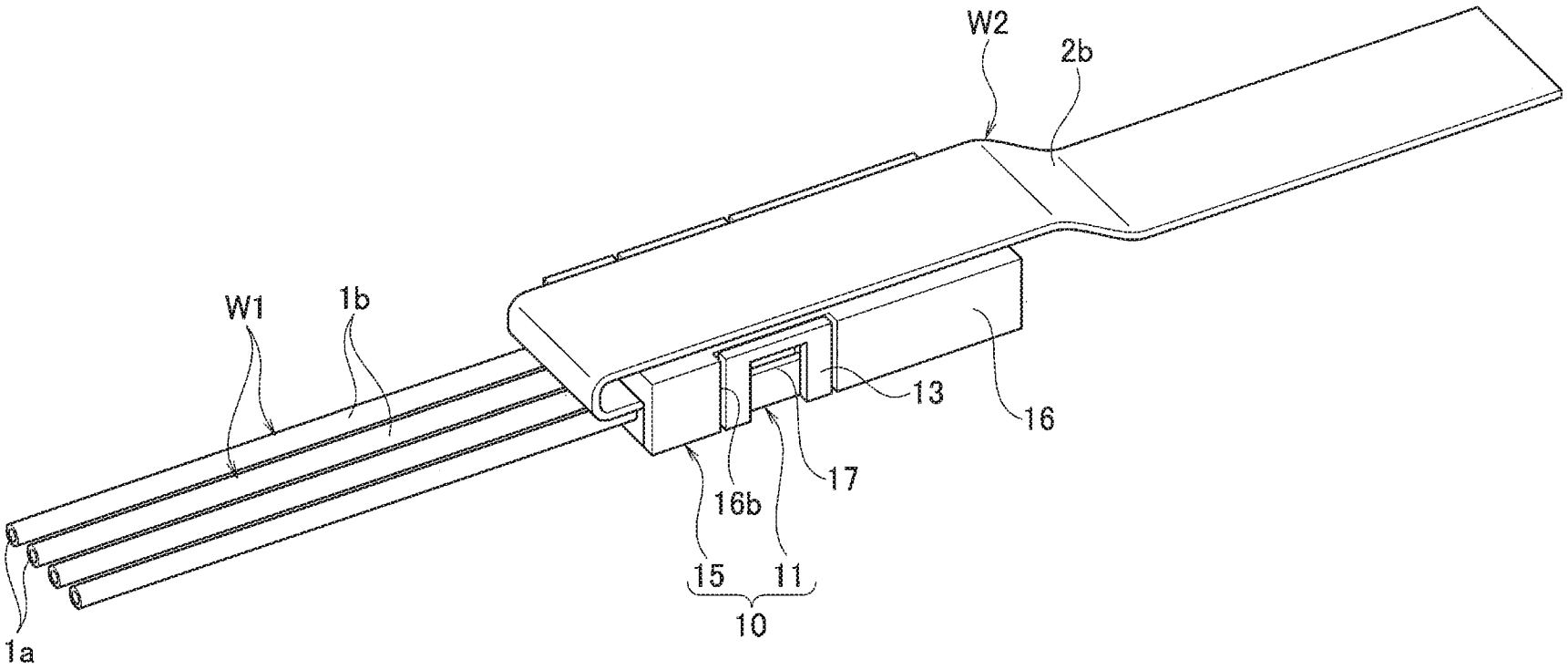
FIG. 7 is a perspective view illustrating a state in which a flat cable is folded back in the cable connection structure according to the second embodiment.

Next, a manufacturing method of the cable connection structure 3B according to the second embodiment will be described. In the manufacturing method of the cable connection structure 3B according to the second embodiment, a cable setting step (cable holding step and holder combining step) and a connecting step are performed in a similar manner to those in the first embodiment, and thus descriptions thereof will be omitted. The manufacturing method of the cable connection structure 3B according to the second embodiment is different from the first embodiment only in an insert resin molding step. That is, as illustrated in FIG. 7, in the insert resin molding step, insert resin molding is performed in such a manner that the flat cable W2 is bent to be guided in the direction different from the pulled-out direction from the flat cable holder 15, specifically, set in the diametrically opposite pulled-out direction, and the mold resin portion 21 is molded. In this manner, the cable connection structure 3B according to the second embodiment as illustrated in FIGS. 6A and 6B is produced.

Third Embodiment

FIGS. 9A to 18 illustrate a third embodiment. A cable connection structure 3C according to the third embodiment includes a plurality of round cables W1, a flat cable W2, a holder 10A for holding end portions of the plurality of round cables W1 and the end portion of the flat cable W2, connecting portions 20 in which core wires 1*a* of the round cables W1 and conductors 2*a* of the flat cable W2 are connected respectively, and a heat shrinkable tube 24 to which a hot melt adhesive (thermoplastic adhesive) 23 is attached and which is a waterproof exterior portion covering the outer circumference of the holder 10A.

Each of the round cables W1 has a round cross section, and includes the core wire 1*a* and an insulating sheath 1*b* covering the outer circumference of the core wire 1*a*. The core wire 1*a* is exposed from the insulating sheath 1*b* at the end portion of each of the round cables W1.

The flat cable W2 has a cross section in a flat rectangular shape, and includes a plurality of tabular conductors 2*a* arranged in parallel at intervals, and an insulating sheath 2*b* collectively covering the plurality of tabular conductors 2*a*. Each of the conductors 2*a* is exposed from the insulating sheath 2*b* at the end portion of the flat cable W2.

Figure 10A:
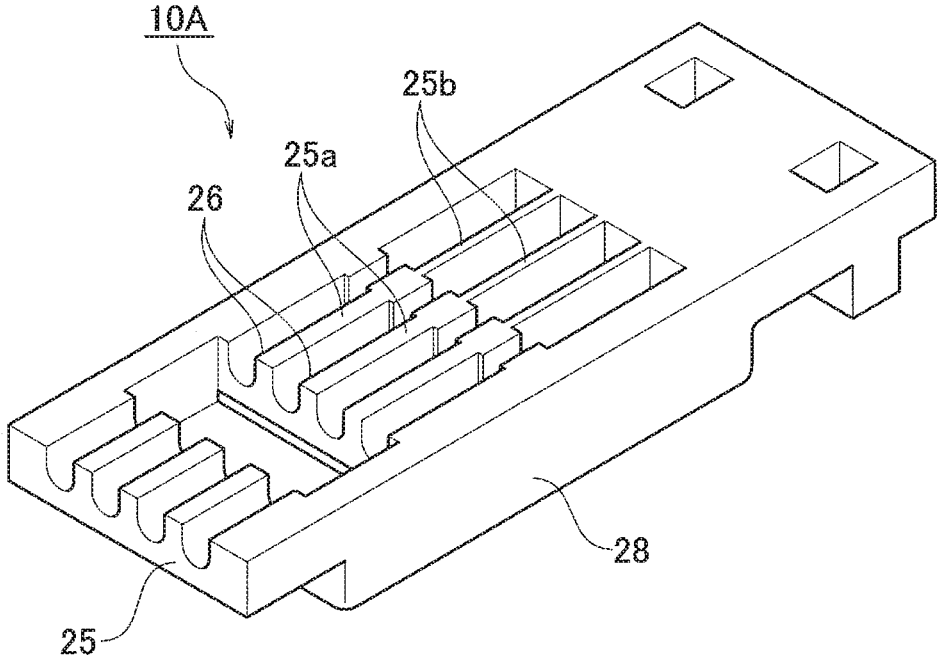
FIG. 10A is a perspective view of a holder of the cable connection structure according to the third embodiment.
Figure 10B:
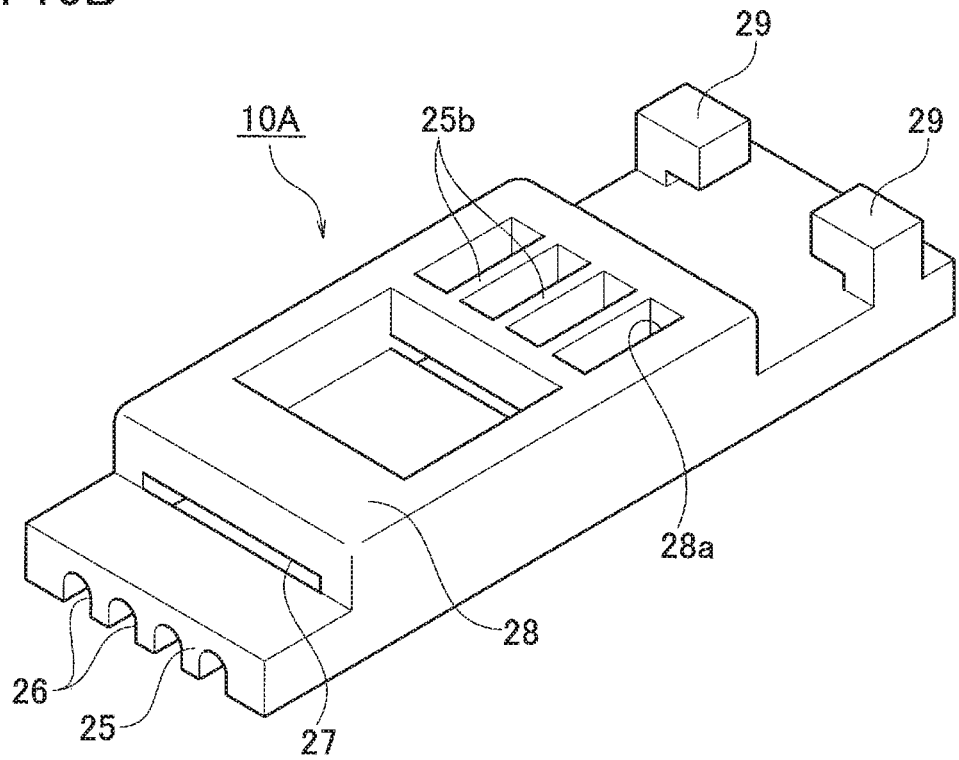
FIG. 10B is a perspective view of the holder as seen from the opposite side of FIG. 10A.

The holder 10A is formed of an insulating material. As illustrated in FIGS. 10A and 10B, the holder 10A includes a plurality of round cable arrangement grooves 26 provided on one side of a base wall 25, and a flat cable arrangement chamber 27 provided on the other side of the base wall 25.

The upper side of each of the round cable arrangement grooves 26 is opened. The round cable arrangement grooves 26 are partitioned by dividing walls 25*a* in the crosswise direction. The distal end side of each of the round cable arrangement grooves 26 in the crosswise direction is partitioned by partition walls 25*b*. At the time of ultrasonic welding, the horn 33 of the ultrasonic welding device 30 is inserted from the opening portions above the partition walls 25*b*. Each of the round cables W1 is arranged in the corresponding round cable arrangement groove 26 in such a manner that the core wire 1*a* exposed at the end portion is positioned at the portion partitioned by the partition walls 25*b*.

The flat cable arrangement chamber 27 is formed to be surrounded by the base wall 25 and a surrounding wall 28 covering the lower part of the base wall 25. The partition walls 25*b* extend toward the distal end side of the flat cable arrangement chamber 27 in the crosswise direction. The distal end side of the flat cable arrangement chamber 27 is partitioned in the crosswise direction by the partition walls 25*b*. A plurality of through holes 28*a* opened to the flat cable arrangement chamber 27 is formed at the position on the surrounding wall 28 where the partition walls 25*b* are positioned. At the time of ultrasonic welding, the anvil 34 of the ultrasonic welding device 30 is inserted from the through holes 28*a*. The flat cable W2 is arranged in the flat cable arrangement chamber 27 in such a manner that the conductors 2*a* exposed at the end portion are positioned at the portions partitioned by the partition walls 25*b*.

On the base wall 25, a pair of hooking claws 29 is provided to protrude from the position on the side opposite to the direction in which the flat cable W2 is inserted into the flat cable arrangement chamber 27.

The round cables W1 and the flat cable W2 held by the holder 10A are pulled out from the holder 10A in the same direction. The end portion of each of the round cables W1 and the end portion of the flat cable W2 are arranged to overlap each other.

On the inner circumference surface of the heat shrinkable tube 24, the hot melt adhesive (insulating resin) 23, which is a thermoplastic adhesive, is attached over the entire region. The hot melt adhesive 23 is thermally melted by heating to the heat shrinkable tube 24 to collectively cover the outer exposed surface of the holder 10A and the outer circumference of the round cables W1 and the flat cable W2 pulled out from the holder 10A with no gap left, and is solidified. The heat shrinkable tube 24 is made in the shrunk state, and covers the outer circumference of the solidified hot melt adhesive 23 with no gap left.

In the cable connection structure 3C according to the third embodiment, the hot melt adhesive (insulating resin) 23 is firmly attached to, with no gap left, the outer circumference surface of each of the round cables W1 and the outer circumference surface of the flat cable W2 at the position of the round cables W1 pulled out from the hot melt adhesive 23 to the outside and the position of the flat cable W2 also pulled out from the hot melt adhesive 23 to the outside, thereby securing waterproof property of the connecting portion 20.

Next, a manufacturing method of the cable connection structure 3C according to the third embodiment will be described. The manufacturing method of the cable connection structure 3C according to the third embodiment is performed in the order of a cable setting step, a connecting step, and a tube shrinking step that is an exterior forming step. Hereinafter, the manufacturing method of the cable connection structure 3C according to the third embodiment will be described in order.

Figure 11:
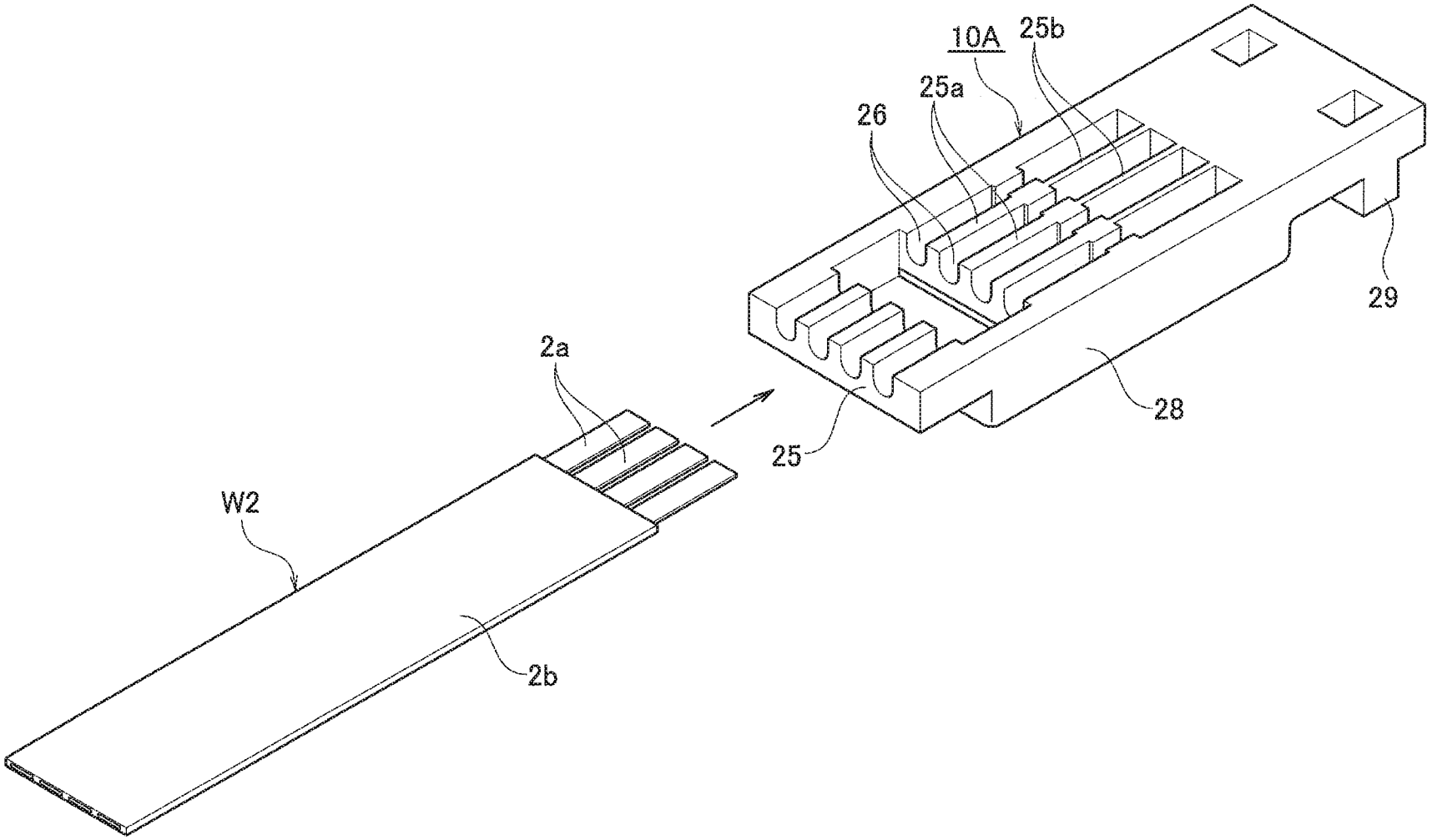
FIG. 11 is a perspective view of a flat cable before being set in the holder in the cable connection structure according to the third embodiment.
Figure 12A:
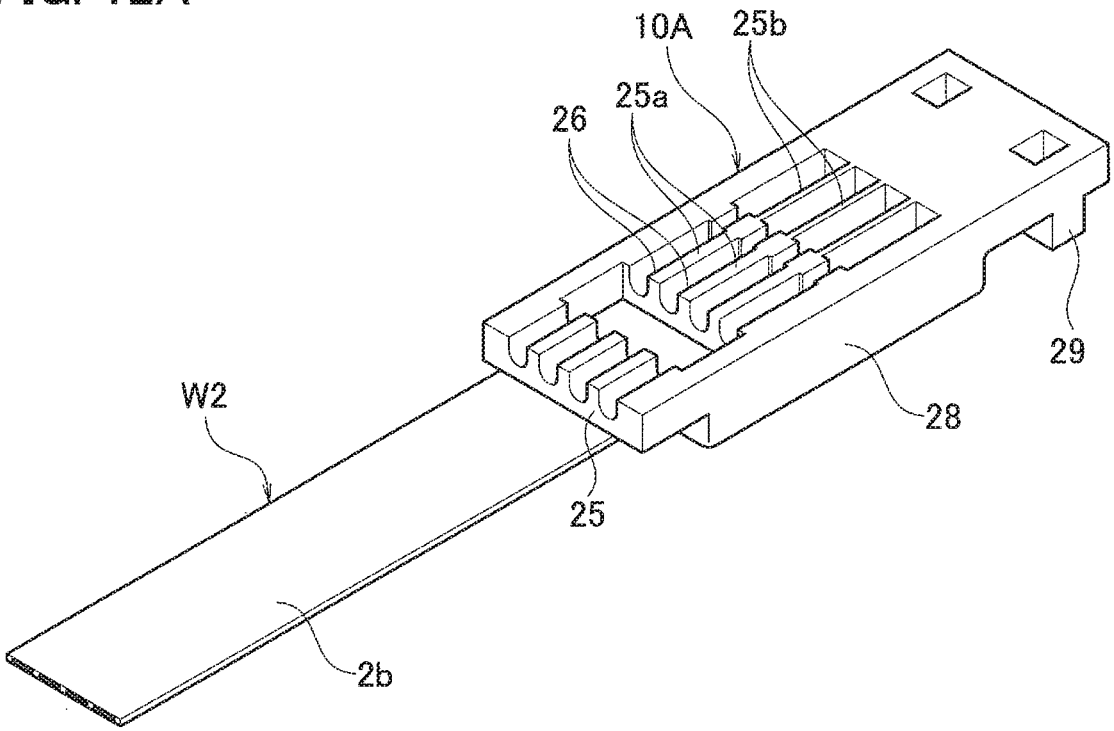
FIG. 12A is a perspective view of the flat cable set in the holder in the cable connection structure according to the third embodiment.
Figure 12B:
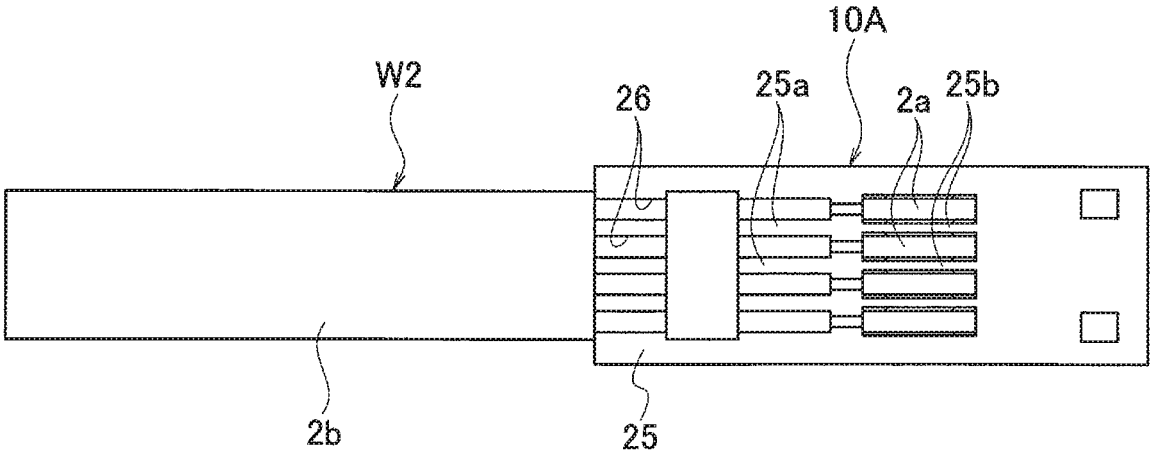
FIG. 12B is a plan view of the state in FIG. 12A.

In the cable setting step, as illustrated in FIG. 11, the end portion of the flat cable W2 as an insertion distal end is inserted into the flat cable arrangement chamber 27 of the holder 10A. Then, as illustrated in FIGS. 12A and 12B, the end portion of the flat cable W2 is arranged in the flat cable arrangement chamber 27 in such a manner that the conductors 2*a* exposed at the end portion of the flat cable W2 are positioned at the positions exposed from the upper openings of the partition walls 25*b* (positions above the through holes).

Figure 13A:
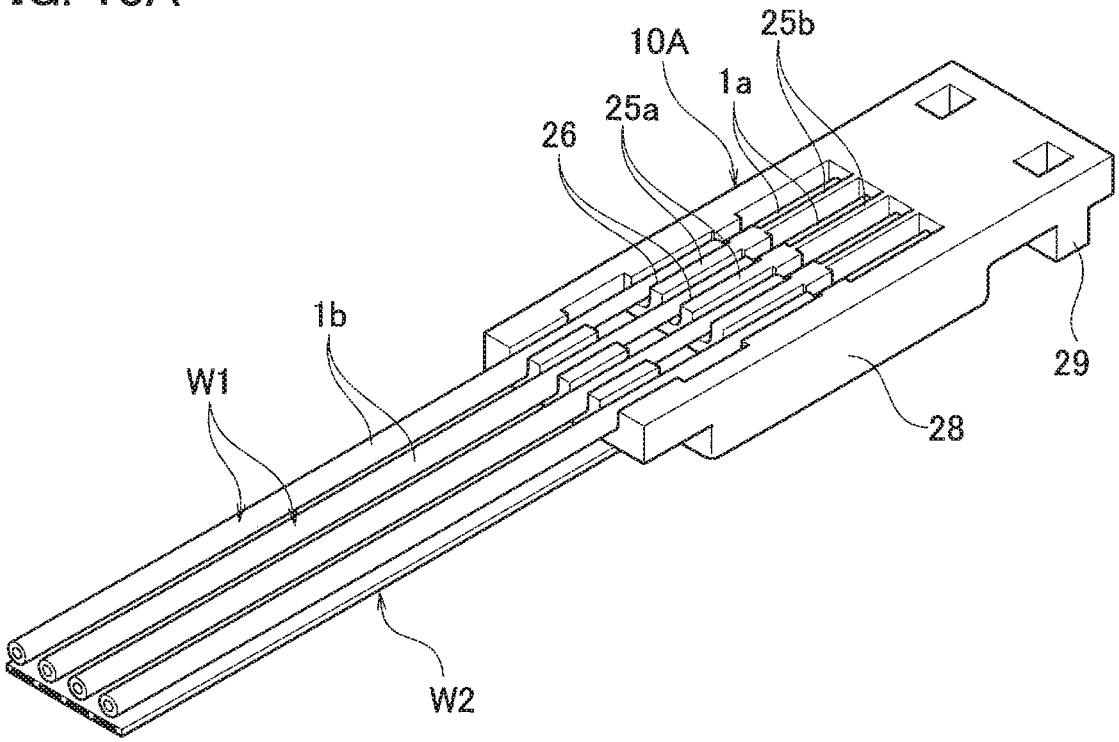
FIG. 13A is a perspective view of the flat cable and round cables set in the holder in the cable connection structure according to the third embodiment.
Figure 13B:
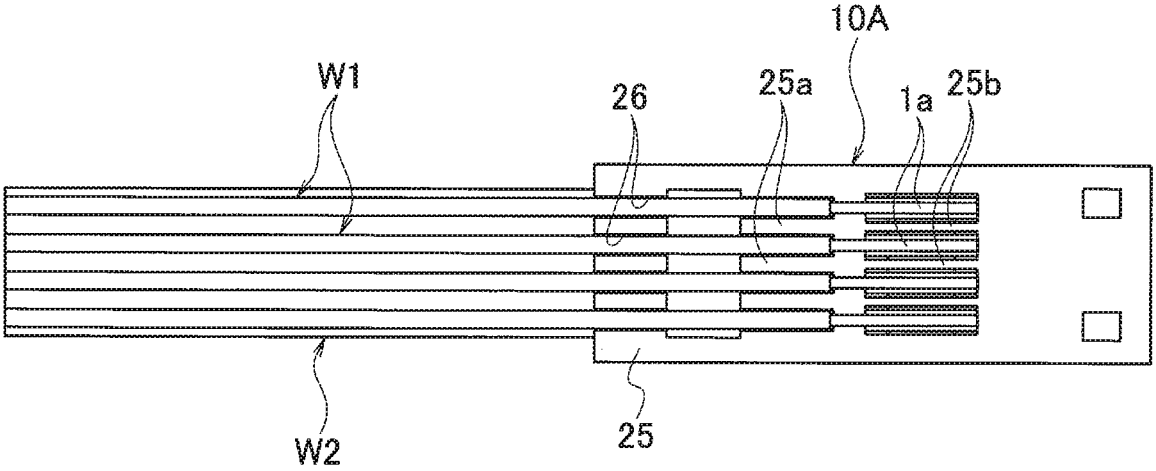
FIG. 13B is a plan view of the state in FIG. 13A.

Next, the round cables W1 are inserted into the round cable arrangement grooves 26 from above the holder 10A. Then, as illustrated in FIGS. 13A and 13B, the round cables W1 are arranged in the round cable arrangement grooves 26 such that the core wires 1*a* exposed at the end portions of the round cables W1 are positioned to be exposed from the upper openings of the partition walls 25*b* (positions above the conductors 2*a*). The flat cable W2 and the round cables W1 may be set in the holder 10A in no particular order. They may be set simultaneously.

The core wires 1*a* exposed at the end portions of the round cables W1 and the conductors 2*a* exposed at the end portion of the flat cable W2 are arranged to overlap each other, and the overlapping portions are exposed from the holder 10A to the outside. The round cables W1 and the flat cable W2 are pulled out from the holder 10A to overlap each other in the same direction.

Figure 14:
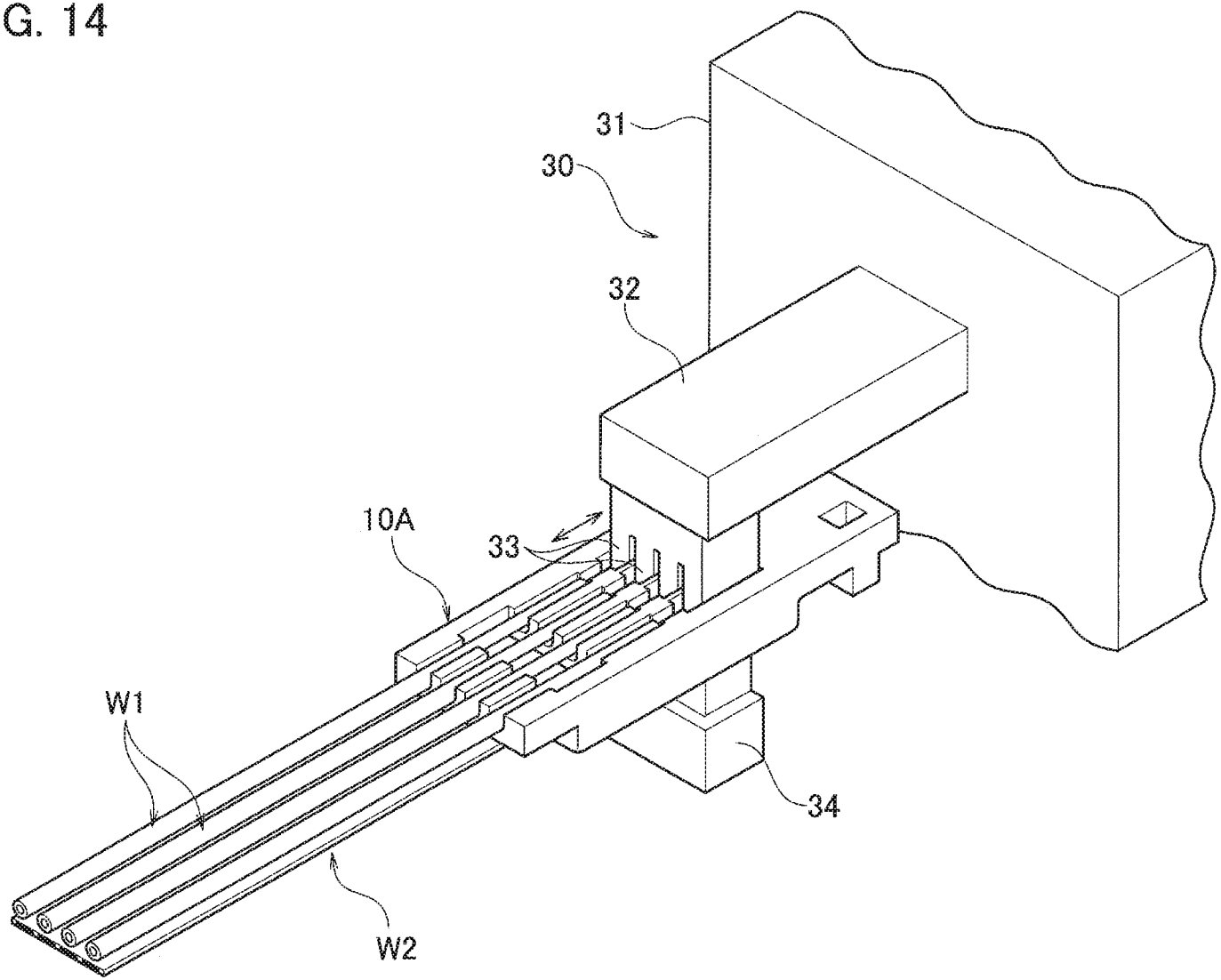
FIG. 14 is a perspective view illustrating a state of ultrasonic welding in the cable connection structure according to the third embodiment.

In the connecting step, the round cables W1 and the flat cable W2 are electrically connected by ultrasonic welding using the ultrasonic welding device 30. As illustrated in FIG. 14, the ultrasonic welding device 30 includes the anvil 34, and the horn 33 arranged at the position facing the anvil 34. The horn 33 is provided at the distal end of an arm portion 32 whose base end portion is supported by a device main body 31.

As illustrated in FIG. 14, in the connecting step, the round cables W1 and the flat cable W2 pulled out from the holder 10A are not arranged in the space between the horn 33 and the device main body 31, but are arranged in the open space on the opposite side, in such a manner that the holder 10A is positioned on the anvil 34. Then, by the branched horn 33, ultrasonic vibration is applied (in the direction of the arrow in FIG. 14) to, while pressure is applied, the position in which the core wires 1*a* exposed at the end portions of the round cables W1 and the conductors 2*a* exposed at the end portion of the flat cable W2 overlap each other. As a result, the core wires 1*a* of the round cables W1 and the conductors 2*a* of the flat cable W2 are connected by the ultrasonic welding.

Figure 15:
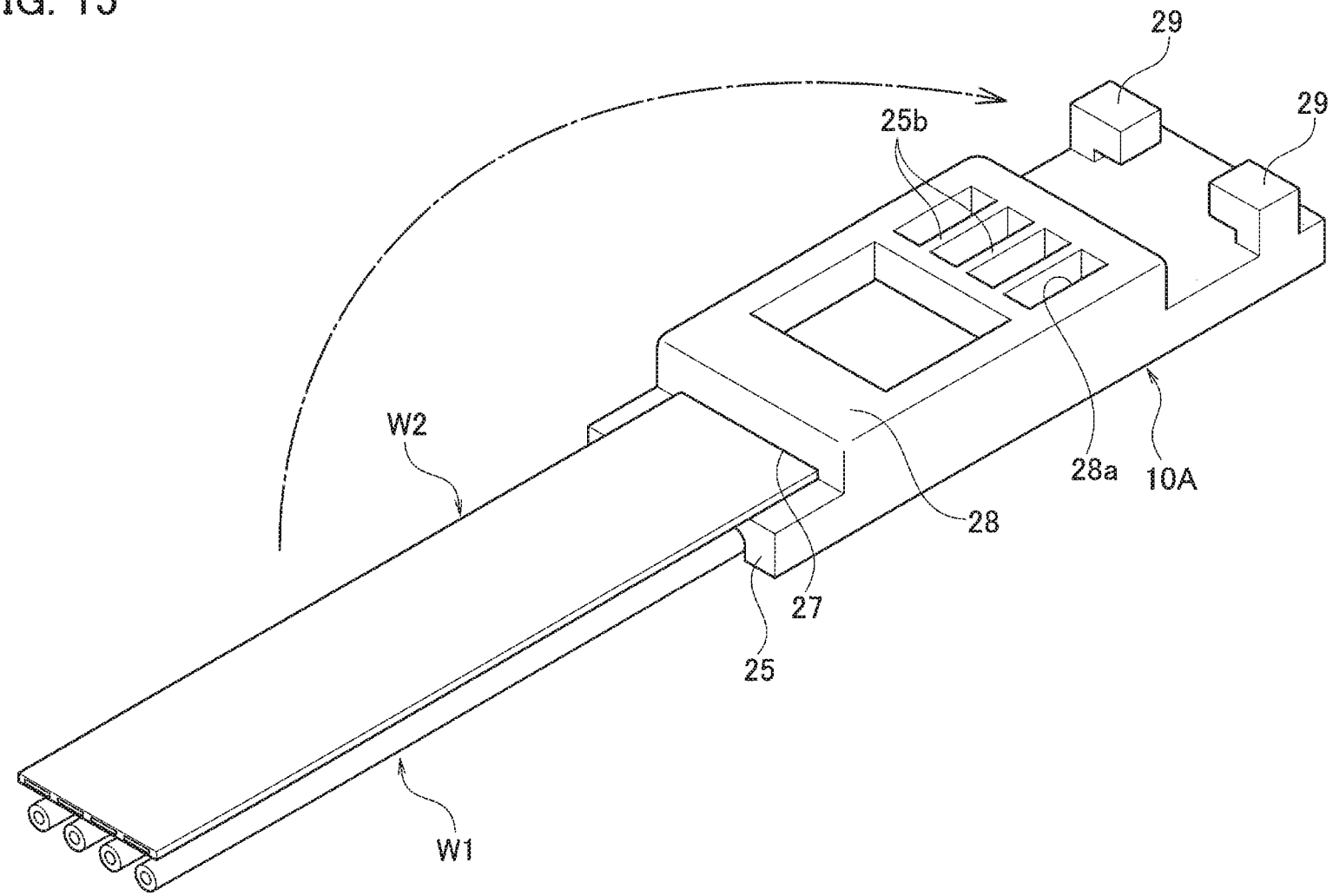
FIG. 15 is a perspective view illustrating a state after the ultrasonic welding in the cable connection structure according to the third embodiment.
Figure 16:
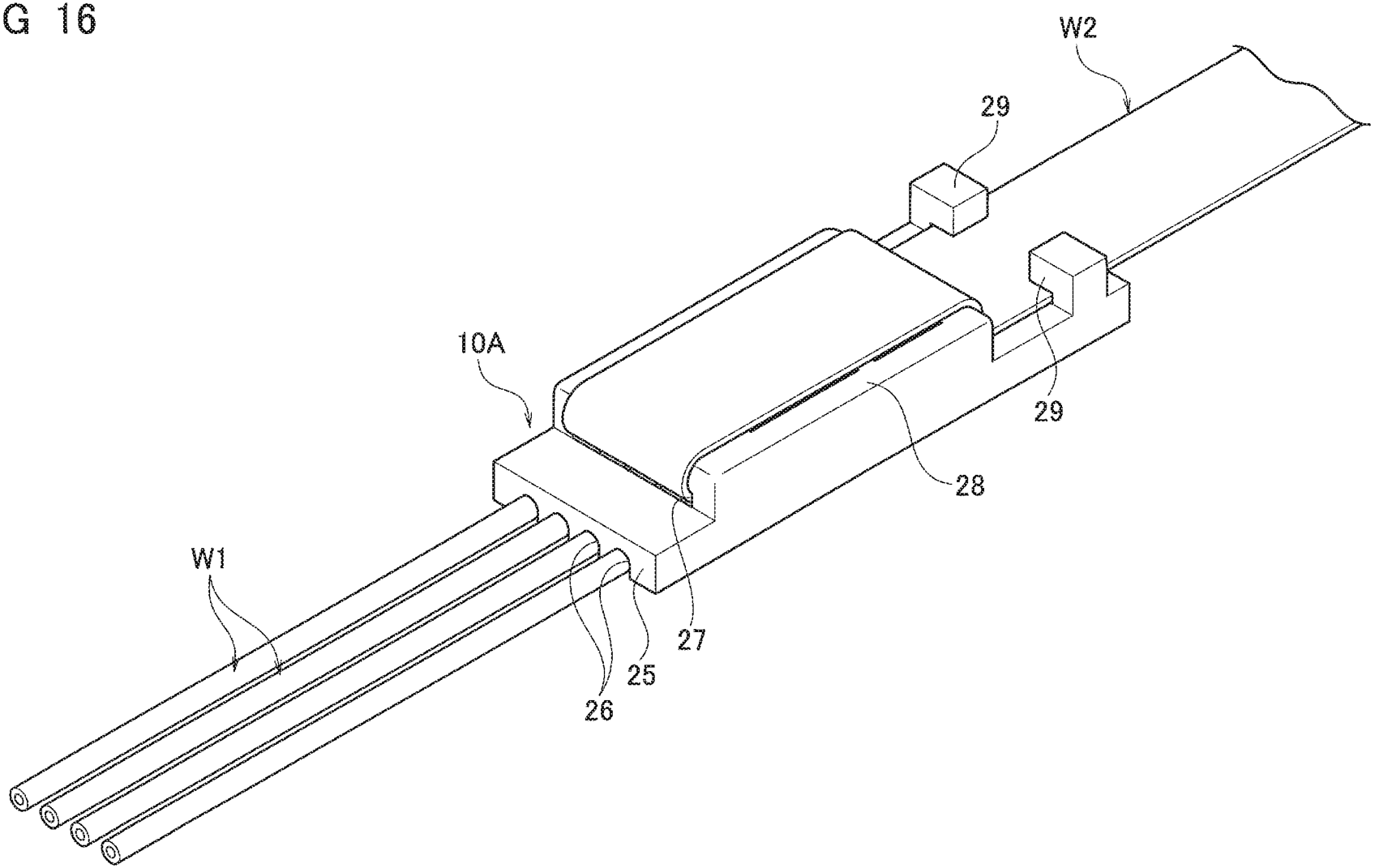
FIG. 16 is a perspective view illustrating a state in which the flat cable is folded back in the cable connection structure according to the third embodiment.
Figure 17A:
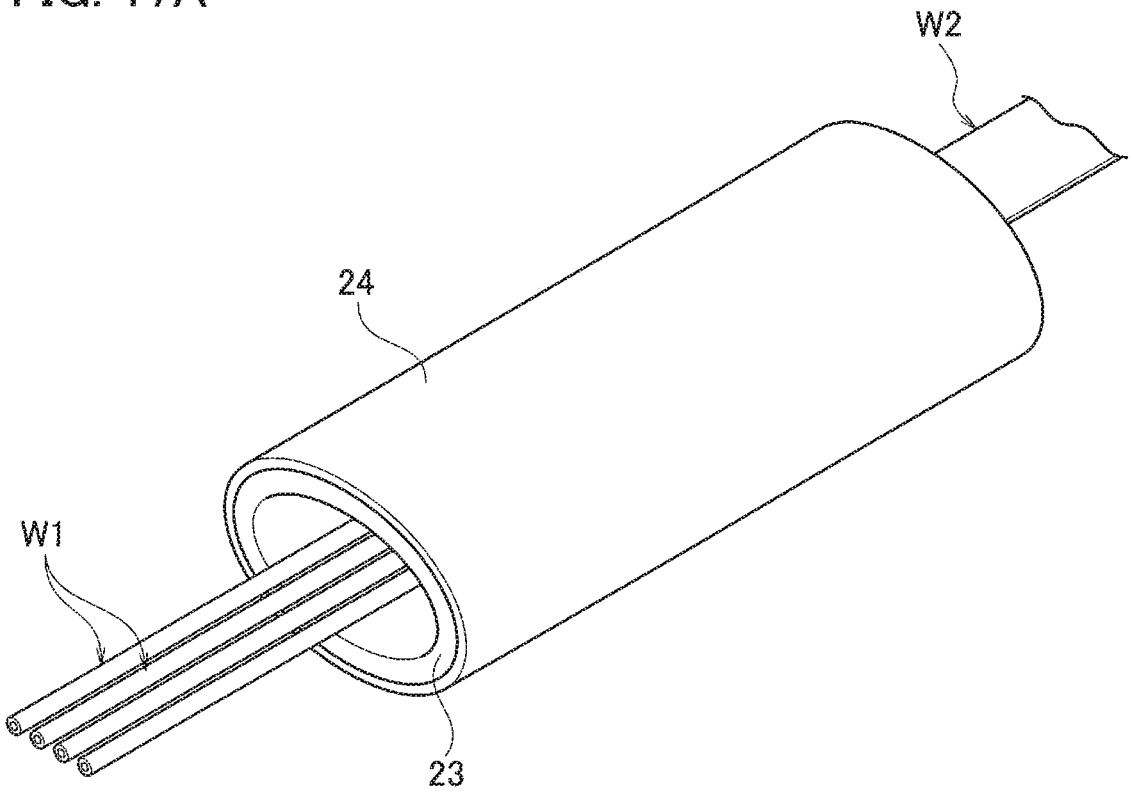
FIG. 17A is a perspective view illustrating a state in which the holder is arranged in a heat shrinkable tube in the cable connection structure according to the third embodiment.
Figure 17B:
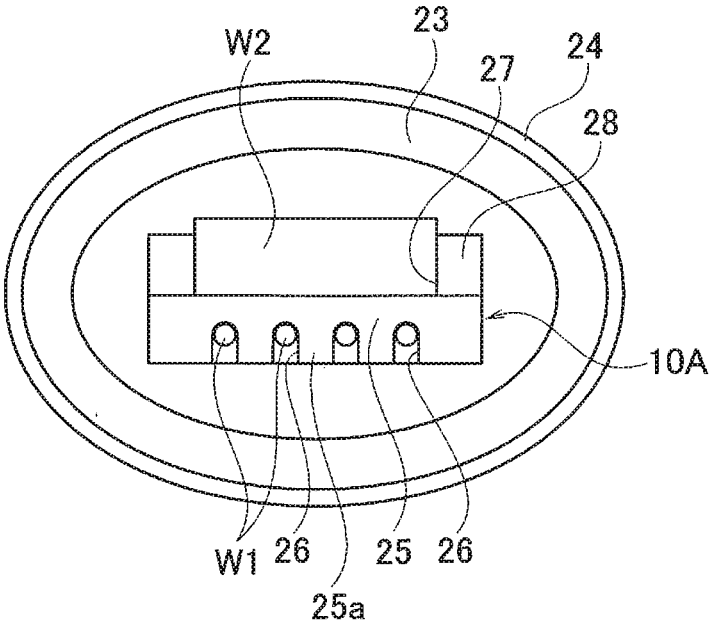
FIG. 17B is a front view illustrating the state in which the holder is arranged in the heat shrinkable tube in the cable connection structure according to the third embodiment.

In the tube shrinking step, first, the flat cable W2 is bent in the direction indicated by the broken line arrow in FIG. 15, and then made in the state of being guided in the direction different from the pulled-out direction from the holder 10A, specifically, in the diametrically opposite pulled-out direction as illustrated in FIG. 16. Then, as illustrated in FIGS. 17A and 17B, the holder 10A with the round cables W1 and the flat cable W2 pulled out from mutually different directions is inserted into the heat shrinkable tube 24.

Figure 9A:
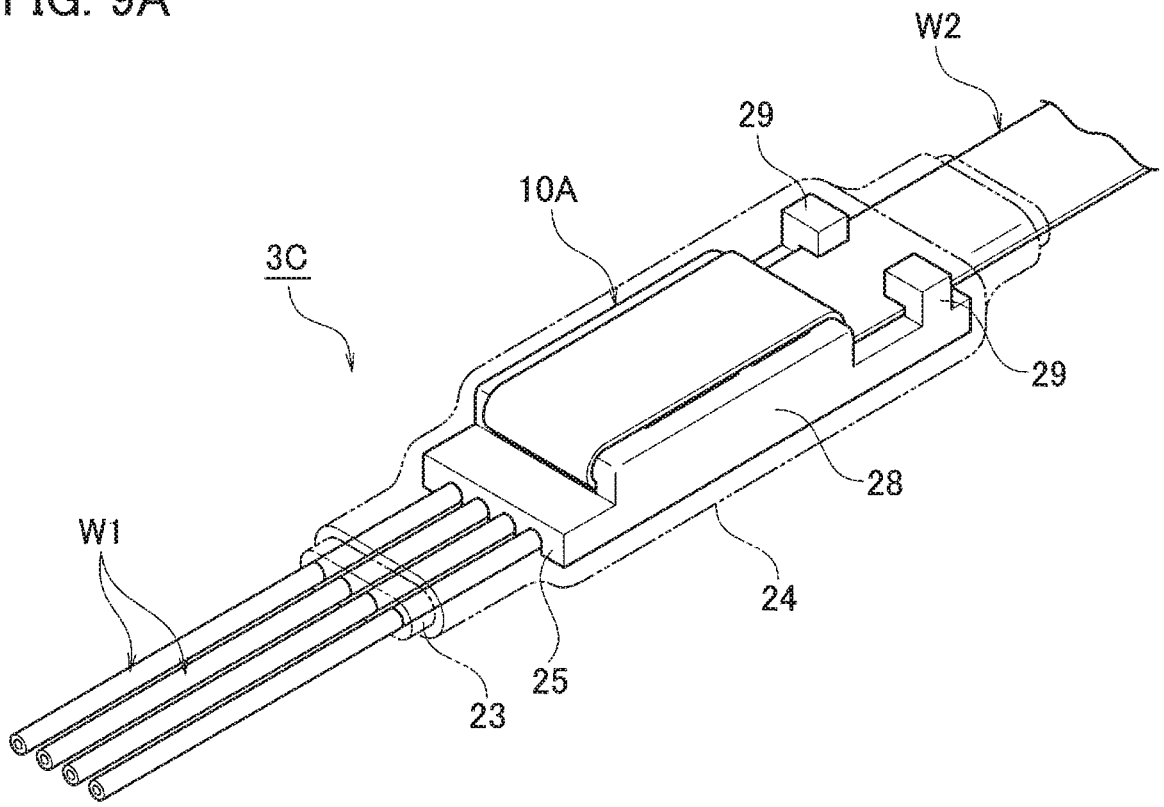
FIG. 9A is a perspective view of a cable connection structure according to a third embodiment (an exterior formation portion is illustrated by a virtual line)
Figure 9B:
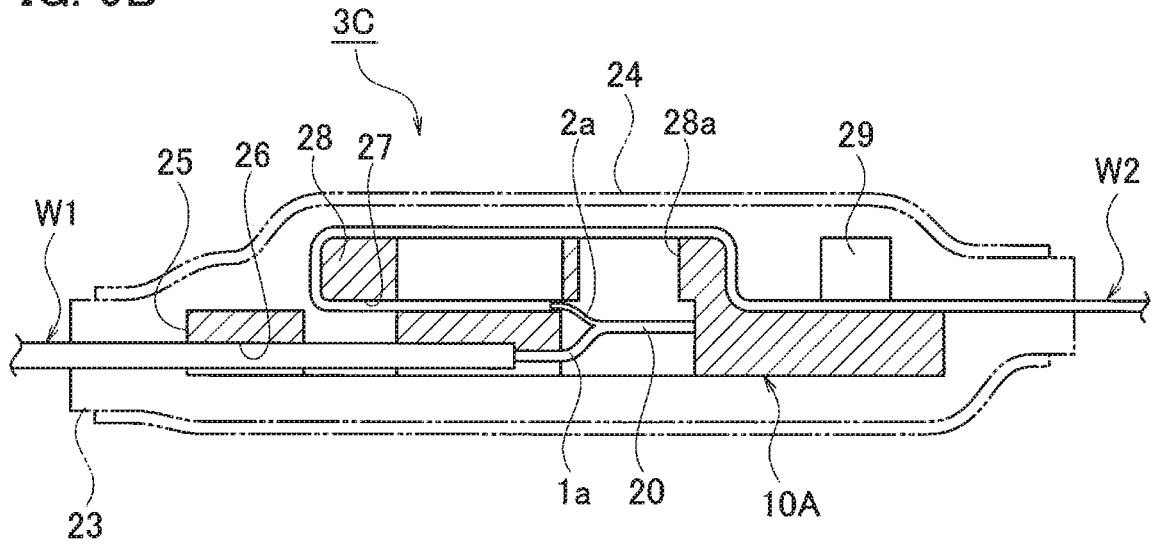
FIG. 9B is a cross-sectional view of a main part of the cable connection structure according to the third embodiment.
Figure 18:
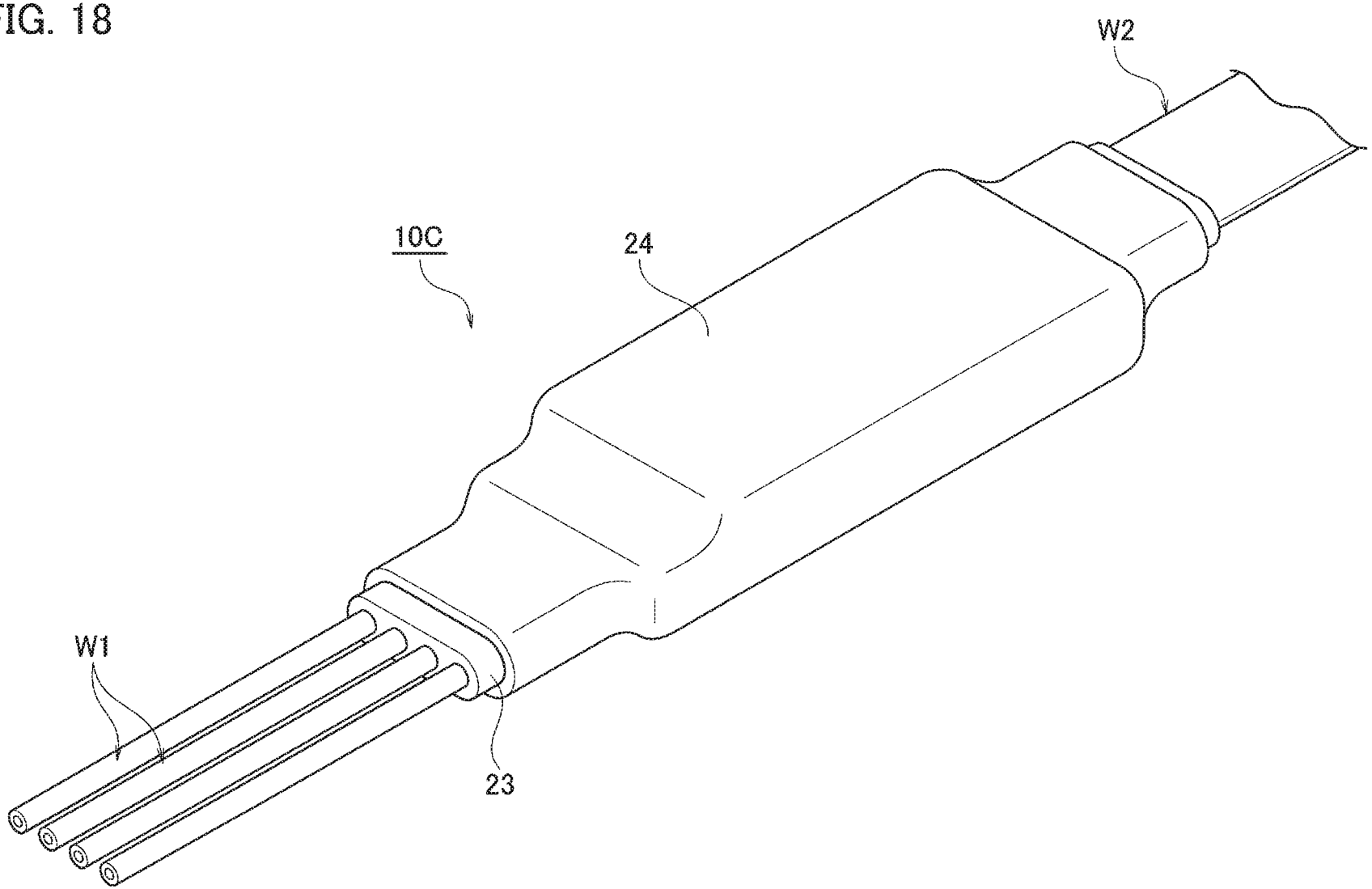
FIG. 18 is a perspective view illustrating a state in which a hot melt adhesive is cured due to thermal action and the heat shrinkable tube is shrunk in the cable connection structure according to the third embodiment.
Figure 19:
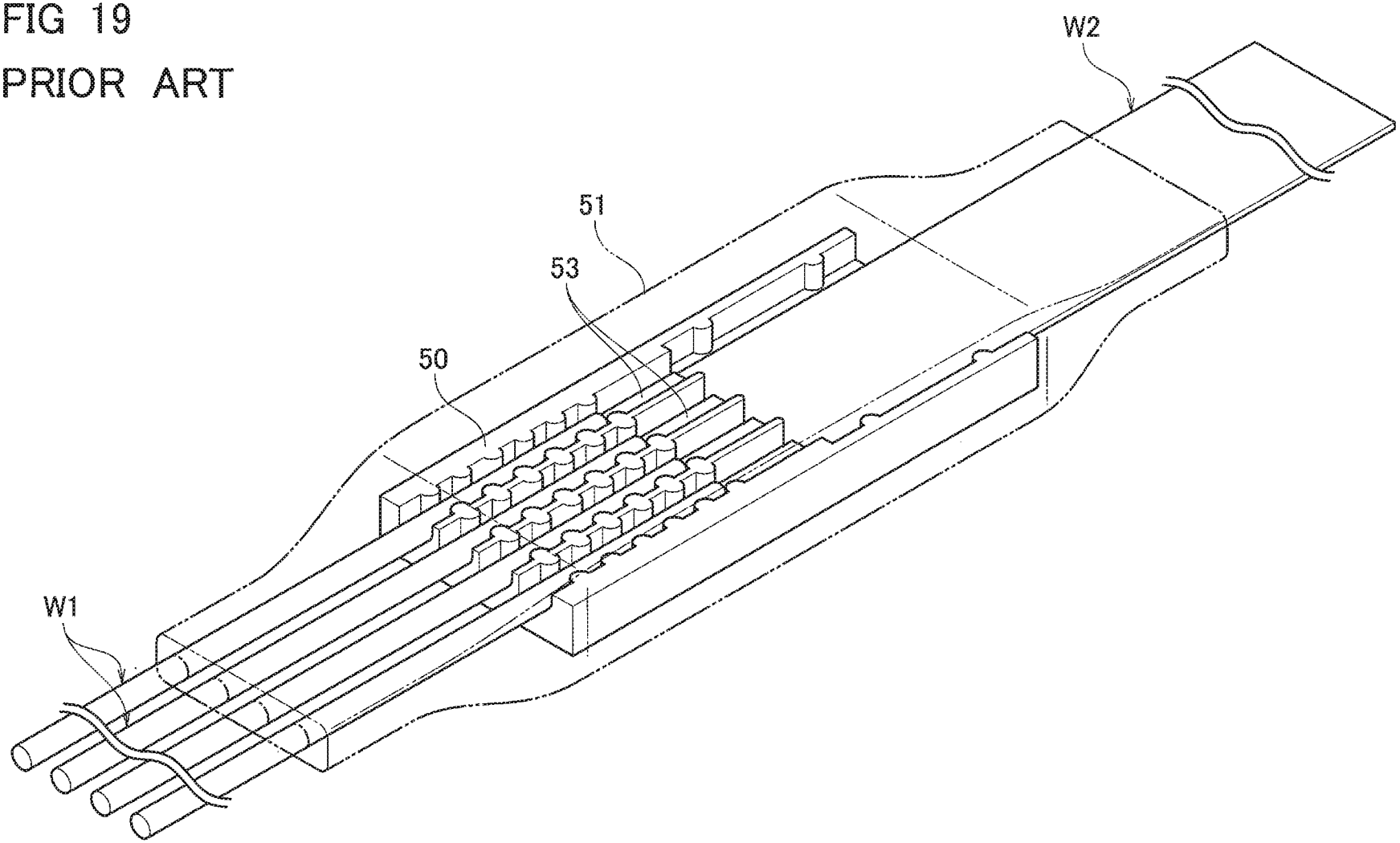
FIG 19 PRIOR ART
FIG. 19 is a perspective view of a conventional cable connection structure.
Figure 20:
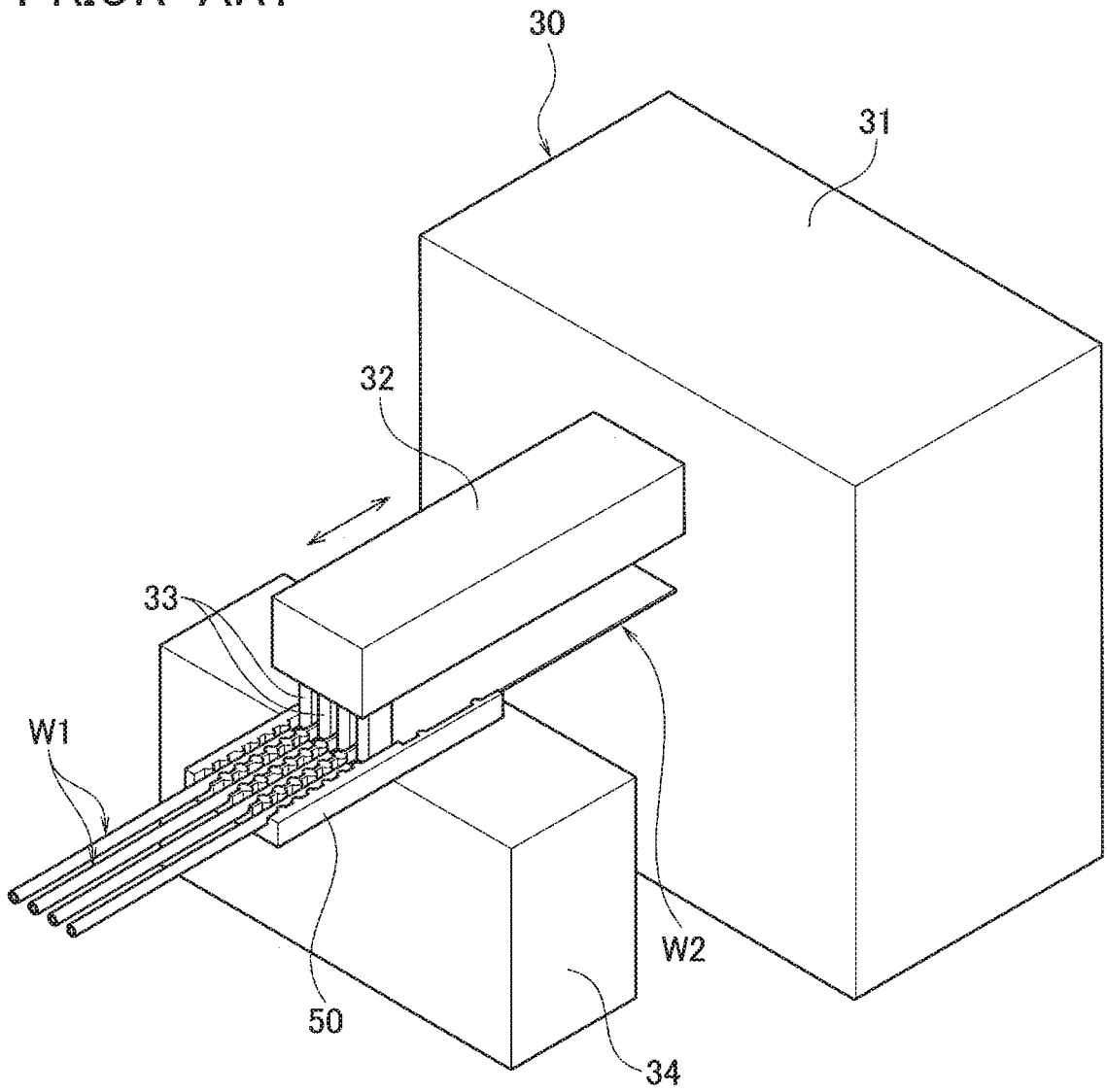
FIG. 20 PRIOR ART
FIG. 20 is a perspective view illustrating a state of ultrasonic welding in the conventional cable connection structure.

Next, the heat shrinkable tube 24 and the hot melt adhesive 23 are heated. Then, as illustrated in FIG. 18, the heat shrinkable tube 24 shrinks while the hot melt adhesive 23 melts (fluidizes). The molten hot melt adhesive 23 is firmly attached onto, with no gap left, the outer exposed surface of the holder 10A, the connecting portions 20 in which the core wires 1*a* of the round cables W1 and the conductors 2*a* of the flat cable W2 held by the holder 10A are connected, the outer circumference of the holder 10A, and the outer circumference of the round cables W1 and the flat cable W2 pulled out from the holder 10A, and is solidified by cooling in the adhered state. As a result, the solidified hot melt adhesive 23 collectively covers the outer exposed surface of the holder 10A, the connecting portions 20 in which the core wires 1*a* of the round cables W1 and the conductors 2*a* of the flat cable W2 held by the holder 10A are connected, the outer circumference of the holder 10A, and the outer circumference of the round cables W1 and the flat cable W2 pulled out from the holder 10A, and the heat shrinkable tube 24 covers the outer circumference of the hot melt adhesive 23 with no gap left. In this manner, the cable connection structure 3C according to the third embodiment as illustrated in FIGS. 9A and 9B is produced.

As described above, the cable connection structure 3C according to the third embodiment includes the round cables W1 each having a round cross section and including the core wire 1*a* and the round insulating sheath 1*b* covering the outer circumference of the core wire 1*a*, the flat cable W2 having a cross section in a flat rectangular shape and including the tabular conductors 2*a* and the flat insulating sheath 2*b* covering the conductors 2*a*, the holder 10A holding the end portions of the round cables W1 and the end portion of the flat cable W2 and pulls out the round cables W1 and the flat cable W2 in the same direction in an overlapped state, the connecting portions 20 in which the core wires 1*a* exposed from the end portions of the round cables W1 and the conductors 2*a* exposed from the end portion of the flat cable W2 held by the holder 10A are connected, and the heat shrinkable tube 24 to which the hot melt adhesive 23 is attached as a waterproof exterior portion that collectively covers the outer circumference of the holder 10A and the outer circumference of the round cables W1 and the flat cable W2 pulled out from the holder 10A. In the step of connecting the core wires 1*a* of the round cables W1 and the conductors 2*a* of the flat cable W2, the round cables W1 and the flat cable W2 are pulled out from the holder 10 in the same direction, whereby it can be manufactured using a connecting device such as the ultrasonic welding device 30 regardless of a length of the flat cable W2.

(Variation)

In the cable connection structure 3A according to the first embodiment and the cable connection structure 3B according to the second embodiment, the holder 10 is divided into the round cable holder 11 and the flat cable holder 15. However, it may be one component.

In the cable connection structure 3C according to the third embodiment, the holder 10A is one component. However, the holder 10A may be two components as in the cable connection structure 3A according to the first embodiment and the cable connection structure 3B according to the second embodiment.

In the cable connection structure 3C according to the third embodiment, the tube shrinking step is performed in such a manner that the flat cable W2 is bent to be guided in the direction different from the pulled-out direction from the holder 10A and set. However, as in the first embodiment, the flat cable W2 may not be bent, and the tube shrinking step (heating with respect to heat shrinkable tube 24 and hot melt adhesive 23) may be performed while the flat cable W2 and the round cables W1 are pulled out from the holder 10A in the same direction.

In the cable connection structure 3C according to the third embodiment, the heat shrinkable tube 24 that changes its shape by thermal action is used. However, it may be a shrinkable tube that changes its shape by the action of light or the like.

In the first to third embodiments, the core wires 1*a* of the round cables W1 and the conductors 2*a* of the flat cable W2 are connected by ultrasonic welding using the ultrasonic welding device 30. However, it is only necessary to use a connecting device capable of electrically connecting the core wires 1*a* of the round cables W1 and the conductors 2*a* of the flat cable W2, which may be, for example, a resistance welding device.

What is claimed is:

1. A cable connection structure, comprising:

a round cable having a round cross section and including a core wire and a round insulating sheath covering an outer circumference of the core wire;

a flat cable having a cross section in a flat rectangular shape and including a tabular conductor and a flat insulating sheath covering the conductor;

a holder holding an end portion of the round cable and an end portion of the flat cable and pulling out the round cable and the flat cable in a same direction in an overlapped state;

a connecting portion in which the core wire exposed from the end portion of the round cable and the conductor exposed from the end portion of the flat cable held by the holder are connected to each other; and a waterproof exterior portion collectively covering, with an insulating resin, an outer circumference of the holder and an outer circumference of the round cable and the flat cable pulled out from the holder.

2. The cable connection structure according to claim 1, wherein the flat cable is bent to be guided in a direction different from a direction in which the flat cable is pulled out from the holder, and the round cable and the flat cable are pulled out from the waterproof exterior portion in different directions.

3. The cable connection structure according to claim 1, wherein the waterproof exterior portion is a mold resin portion.

4. The cable connection structure according to claim 1, wherein the waterproof exterior portion is a heat shrinkable tube to which a thermoplastic adhesive is attached, and the thermoplastic adhesive is in a solidified state, and the heat shrinkable tube in a shrunk state covers an outer circumference of the thermoplastic adhesive.

5. The cable connection structure according to claim 1, wherein the holder includes a round cable holder that holds the end portion of the round cable and a flat cable holder that holds the end portion of the flat cable, and the round cable holder and the flat cable holder are capable of being joined together in such a manner that the round cable from the round cable holder and the flat cable from the flat cable holder are pulled out in the same direction in the overlapped state.

6. A manufacturing method of a cable connection structure, comprising:

a cable setting step of holding, in a state in which a round cable and a flat cable are pulled out in a same direction in an overlapped state, an end portion of the round cable and an end portion of the flat cable in a holder;

a connecting step of connecting a core wire exposed from the end portion of the round cable held by the holder and a conductor exposed from the end portion of the flat cable held by the holder; and an exterior forming step of forming a waterproof exterior portion covering, with an insulating resin, the holder, the round cable pulled out from the holder, and the flat cable pulled out from the holder.

7. The manufacturing method according to claim 6, wherein in the exterior forming step, exterior forming processing is performed while the flat cable is set in a state where the flat cable is bent to be guided in a direction different from a direction in which the flat cable is pulled out from the holder.

8. The manufacturing method according to claim 6, wherein the exterior forming step is an insert resin molding step in which a mold resin portion is molded by insert resin molding using, as inserts, the holder, the round cable pulled out from the holder, and the flat cable pulled out from the holder.

9. The manufacturing method according to claim 6, wherein the exterior forming step is a tube shrinking step in which the holder, the round cable pulled out from the holder, and the flat cable pulled out from the holder are arranged in a heat shrinkable tube with thermoplastic adhesive attached to an inner surface of the heat shrinkable tube, and a waterproof exterior portion is formed by changing a shape of the thermoplastic adhesive and the heat shrinkable tube by heating the heat shrinkable tube.

10. The manufacturing method according to claim 6, wherein the holder includes a round cable holder that holds the end portion of the round cable and a flat cable holder that holds the end portion of the flat cable, and the cable setting step includes:

a cable holding step of holding the end portion of the round cable in the round cable holder and of holding the end portion of the flat cable in the flat cable holder; and a holder combining step of combining the round cable holder and the flat cable holder in such a manner that the round cable from the round cable holder and the flat cable from the flat cable holder are pulled out in the same direction in the overlapped state.

* * * * *